United States Patent [19]

Plouff et al.

[11] Patent Number: 4,918,630

[45] Date of Patent: Apr. 17, 1990

[54] COMPUTER TIMING SYSTEM HAVING BACKUP TRIGGER SWITCHES FOR TIMING COMPETITIVE EVENTS

[75] Inventors: Donald A. Plouff, Noblesville, Ind.; Robert H. Weller, Rothschild, Wis.

[73] Assignee: GTE North Incorporated, Westfield, Ind.

[21] Appl. No.: 281,131

[22] Filed: Dec. 7, 1988

[51] Int. Cl.[4] ..... G04F 8/00

[52] U.S. Cl. ..... 364/569; 368/113

[58] Field of Search ..... 368/113, 112, 111, 110, 368/10, 9, 3, 1; 364/569, 411; 377/20, 5

[56] References Cited

U.S. PATENT DOCUMENTS 4,156,870 5/1979 Desarzens ..... 377/20 X 4,505,595 3/1985 Rose et al. ..... 368/113 X

*Primary Examiner*—Parshotam S. Lall

*Assistant Examiner*—Steven A. Melnick

[57] ABSTRACT

A computer system is provided for timing contestants on a water race course. A computer interfaces through a card to four switches. A manual and an automatic switch are activated upon the contestant starting the race. Other manual and automatic switches are activated upon the contestant finishing the race. The computer has software which allows the time at which each switch is activated to be recorded and associated with the contestant. The start and finish times are determined by the respective automatic switches unless an automatic switch misfunctions, and doesn't provide a time. In that case, the start or finish time is determined from the affiliated manual switch. The software subtracts start time from finish time to yield elapse time.

4 Claims, 4 Drawing Sheets

```
  GTE   WHITEWATER SLALOM TIMING  V3.1            01/21/88 21:57:41.01
--- - --- ---------- --------- --------- ------- --- ------- --- --- ---------
CL# R BIB Last Name    START    FINISH     TIME  PEN  TOTAL  BIB BIB Finishes
```

```
F1  This HELP screen
F2  XFER finish time
F3  Set Start Time
F4  Duplicate Class or Start
F5
F6  TEST
F7  Update data on disk
F8  Mark "DNF"
F9  Recalculate
F10 Mark "DNR"
Esc Esc -> Exit
```

FIG. 2

T E S T

| AUTOMATIC - MANUAL START Switches | | AUTOMATIC - MANUAL FINISH Switches | |
|---|---|---|---|
| OPEN | OPEN | OPEN | OPEN |

Press any key to finish test

FIG. 3

GTE WHITEWATER SLALOM TIMING V3.1 01/21/88 21:50:57.04

| CL# | R | BIB | Last Name | START | FINISH | TIME | PEN | TOTAL | BIB | BIB | Finishes |
|---|---|---|---|---|---|---|---|---|---|---|---|
| C1M | 1 | 010 | SMITH | 33:37.55C | 35:04.01C | 86.46 | 020 | 106.46 | 010 | | 35:04.01C |
| C1M | 1 | 020 | JONES | 34:16.60C | 35:44.38C | 87.78 | 005 | 92.78 | 020 | | 35:44.38C |
| C1M | 1 | 026 | MCKAY | 34:39.51C | 36:06.24C | 86.73 | 015 | 101.73 | 026 | | 36:06.24C |
| C1M | 1 | 033 | ROGERS | 34:56.37C | 36:29.03C | 92.66 | 000 | 92.66 | 033 | | 36:29.03C |
| K1W | 1 | 040 | SAMSON | 45:02.25C | -DNF- | 9999.99 | | 9999.99 | 055 | | 46:38.37A |
| K1W | 1 | 055 | QUAIL | 45:36.12C | 46:38.37A | 62.25 | 045 | 107.25 | 057 | | 49:17.60C |
| K1W | 1 | 048 | HANSON | 46:36.12C | -DNR- | 9999.99 | | 9999.99 | | | |

FIG. 4

```
    Automatic START   22:33:37.55
** Manual START   22:33:37.83
Automatic START   22:34:16.60
** Manual START   22:34:16.99
Automatic START   22:34:39.51
** Manual START   22:34:40.06
Automatic START   22:34:56.37
** Manual START   22:34:56.65
Automatic FINISH  22:35:03.79
Automatic FINISH  22:35:04.01
** Manual FINISH  22:35:04.17
Automatic FINISH  22:35:04.23
Set/verified start time  33:37.55C  010
Set/verified start time  34:16.60C  020
Set/verified start time  34:39.51C  026
Set/verified start time  34:56.37C  033
Transfered finish time  35:04.01C  010
Automatic FINISH  22:35:44.16
Automatic FINISH  22:35:44.38
** Manual FINISH  22:35:44.49
Automatic FINISH  22:35:44.60
Transfered finish time  35:44.38C  020
Automatic FINISH  22:36:06.02
Automatic FINISH  22:36:06.24
** Manual FINISH  22:36:06.24
Transfered finish time  36:06.24C  026
Automatic FINISH  22:36:28.81
Automatic FINISH  22:36:29.03
** Manual FINISH  22:36:29.03
Transfered finish time  36:29.03C  033
```

FIG. 5

COMPUTER TIMING SYSTEM HAVING BACKUP TRIGGER SWITCHES FOR TIMING COMPETITIVE EVENTS

INFORMATION ON COPYRIGHTED MATERIAL

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyrights rights whatsoever.

BACKGROUND OF THE INVENTION

This invention pertains to computer time measuring systems and more particularly is concerned with computer systems for timing races.

A particularly difficult race to time accurately is the so called whitewater slalom event. In this sporting event, a plurality of contestants in canoes or kayaks race serially down about a half mile stretch of rapids, attempting to maneuver through portals and around obstacles.

An important criteria to win is the time a contestant takes between the start and finish positions. Penalty times for missing a prescribed maneuver are added to the elapsed time. The contestant with the lowest overall time wins. Often the difference between contestant's times are fractions of a second. Further, the start and finish positions are so separated that a single official can not time the runs. Electronic time measuring apparatus is therefore used to enhance accuracy and to promptly report results. For this purpose a pivotable wand is located in the waterway at the starting position and closes a switch when activated by a racer's start. Photoelectric cells are used at the finish line. The wand and photoelectronic cell usually give precise time signals, but are not always reliable. The wand arrangement has been known to misfuction and not provide a start signal. Photoelectric cells can malfunction and generate a false signal.

Accordingly, it is desirable, and an object of the invention, to provide means to back up the electronic system while retaining the accuracy of the electronic system where possible.

SUMMARY OF THE INVENTION

Briefly, according to one aspect of the invention, a computer system is provided for timing contestants on a water race course. A computer interfaces through a card to four switches. A manual and an automatic switch are activated upon the contestant starting the race. Other manual and automatic switches are activated upon the contestant finishing the race. The computer has software which allows the time at which each switch is activated to be recorded and associated with the contestant. The start and finish times are determined by the respective automatic switches unless an automatic switch misfunctions, and doesn't provide a time. In that case, the start or finish time is determined from the affiliated manual switch. The software subtracts start time from finish time to yield elapse time.

BRIEF DESCRIPTION OF THE DRAWING

FIG. 2 shows a sample display of the computer system in help mode;

FIG. 3 shows a sample display in test mode;

FIG. 4 shows a sample display in operating mode; and

FIG. 5 represents a sample printout of the system.

DETAILED DESCRIPTION OF THE INVENTION

Figure 1:
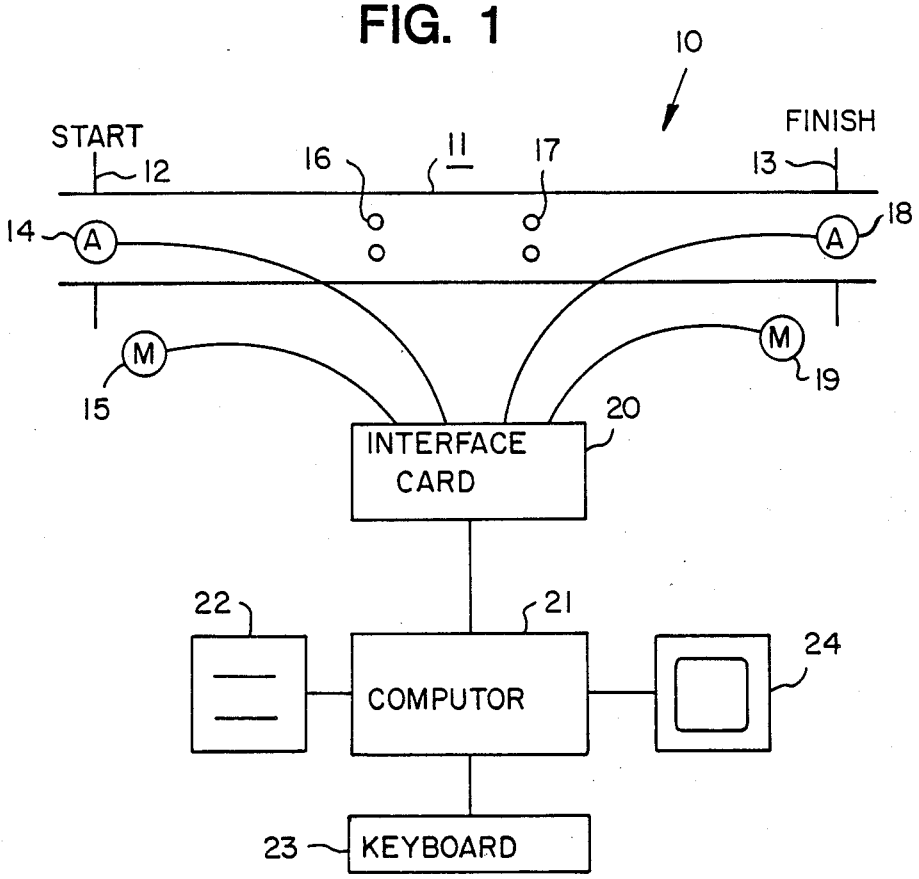
FIG. 1 is a schematic representation of the computer system of the invention.

Turning first to FIG. 1, there is seen a computer time measuring system 10 embodying the best mode of the invention.

A water race course 11 has separate start and finish positions, 12 and 13. Each contestant wears an identification number called a BIB number. When a contestant crosses the start position 12, he or she activates a first automatic switch 14, such as a pivotable wand. At the same time, a race official is positioned to activate a first manual switch 15 and report the contestant's BIB number. As the contestant maneuvers his or her craft downstream, he or she is required to pass through portals 16, and 17. Missing a portal results in penalty points being manually added to his or her race time. A second automatic switch 18, such as a photoelectric cell, signals when the racer crosses the finish position. A race official is to then activate a second manual switch 19 and report the contestant's BIB number.

The manual switches 15, and 19 provide redundancy to the automatic switches 14, and 18 which can misfunction or malfunction.

As a feature of the invention, the two automatic switches 14, and 18 and the manual switches 15, and 19 are coupled to interface card 20 which is an input to computer 21.

Computer 21 may be an IBM PC (TM) or equivalent equipment with an internal 256K or larger RAM memory, a 360K floppy disc drive 22, a keyboard 23, a monitor 24, and a printer 25. Interface card 20 identifies which of the four switches, 14, 15, 18 or 19, is being activated and provides the time of activation. A suitable interface card is sold by MetraByte Corporation of Taunton, Mass. as Model PIO-12. This information, switch identification and activation time, is inputted to computer 21 which is programmed with computer software. The start and finish race officials are in communication with the computer operator and identify by BIB number the contestant then passing the respective position.

A listing of one embodiment of the software is at the end of this description, before the claims. The listing is written in Intel 8088/8086 assembly language. The software flow is described in Table 1.

TABLE 1

| SOFTWARE FLOW |
|---|
| START-UP |
| Turn speaker off (if on). |
| Get printer adapter address. |
| Determine type of display (color/monochrome). |
| Set DOS cursor to row 21 column 1. |
| Clear screen. |
| Determine memory size - |
| Print message and stop program if RAM is less than 256K. |
| Display banner (Timing and software by GTE . . . ) |
| Check for legal date - |

TABLE 1-continued

| SOFTWARE FLOW |
|---|
| Print message and stop program if year is less than 1988. |
| Initialize UART for 1200 Baud, no parity, 8 data bits, 1 stop bit. |
| If error, display message and request acknowledgment by operator. |
| Request new or old race - |
| if old, load old race file, and backup old race file; |
| if new, start fresh, and backup old race file. |
| MAIN STREAM |
| Continuous loop |
| Get date and time - |
| If 55 millisecond timer changes, decrement certain timers, and turn off speaker if speaker timer reaches zero. |
| If seconds change, increment certain timers, decrement others, and update date/time strings. |
| Sample manual and automatic - start and finish switches: |
| If timers for signals are zero, register time when signal occurred. Set timers according to what signal came in. |
| Beep speaker. |
| Check for keyboard and mouse inputs: |
| (See additional information section for operator controls which moves cursor, transfers finish times, acknowledges signals, displays help, etc.) |
| Print one character from printer buffer. |
| Output one character to COM1 if UART is "ready". |
| Test for exit condition (Esc-End from keyboard) - |
| If exit, save data to disk. Ask operator for verification. (See exit condition below). |
| Test display flag (set by several conditions such as cursor move, signal in, etc.) - |
| Update DOS cursor registers. |
| Refresh screen. |
| Calculate raw times and total times. |
| 1-second loop (occurs every second) |
| Display date, time, column headings, etc. |
| 20-second loop |
| Refresh display (which also recalculates totals) |
| Exit routine |
| Clear screen |
| Save race date to disk |
| Display "End Now?" message |
| If no, continue with main loop |
| If yes, terminate program |

The software programs keyboard 23 to function as described in Table 2.

TABLE 2

| KEY FUNCTIONS |
|---|
| Function Keys |
| F1 - Displays Help screen (which appears for 5 seconds max. and is turned off when another key is pressed or mouse is moved). |
| F2 - Transfers finish time from finish column to corresponding BIB numbers finish time if cursor is in appropriate column; displays "Ill-col" if not. Finish times entering system are displayed in flashing mode. |
| F3 - Set start time. Start time comes into system flashing on screen. This entry verifies it by disabling the flashing condition. |
| F4 - Duplicates class or start number below row where cursor exists, if there is not entry in row below, no duplication is made. |
| F6 - Test. This places screen in mode to show status of input signals or switches. See sample test screen. System reacts to input signal in this mode. |
| F7 - Updates data on disk from all display areas. This allows data to then be taken to another computer for summarization while race is underway. This also provides some security in the event of hardware failures. |
| F8 - Mark DNF which places "DNF" in finish column if contestant Does Not Finish. Also places 999.99 in totals column. |
| F9 - Recalculates totals. Generally used for Full-screen edit where recalculations are not done automatically with cursor movement. |
| F10 - Mark DNR for Did Not Race. See F8 above. |

TABLE 2-continued

| KEY FUNCTIONS |
|---|
| Other keys |
| Esc-Esc causes an exit condition. "Y" is entered to verify exit. |
| Alt-E - Places system in Full-Screen-Edit which allows manually entry of Start and Finish times to recreated data if necessary. Screen is placed in inverse mode when in this condition. Alt-E must be reentered to exit. |
| "—" - Allows deletion of entries, times, etc. to allow new start and finish times to synchronize with existing entries. This entry is made twice for verification to avoid errors. The cursor must be in specific columns for action to take effect. |
| SPACE-BAR - is used to erase BIB numbers, race numbers, names, etc. |
| Tab - Places cursor in next entry field. |
| Carriage-Return - places cursor in first column in row below current cursor position. |
| HOME - places cursor in first column of first row. |
| PgUp/PdDn - Moves display up or down 15 lines. |

The help screen format is shown in FIG. 2. The test screen format is shown in FIG. 3.

Class numbers, BIB numbers, race numbers, and contestant's last name are entered manually into the computer before a contestant begins to challenge the course. As times are displayed on the monitor, the operator strings the associated BIB number, as reported by an official, to the start and finish times, using information conveyed from the race official.

The computer monitors four signals:

(1) Automatic start (switch-closure from start-wand)

(2) Manual start (push-button switch-closure activated by a start official)

(3) Automatic finish (electric-eye switch-closure)

(4) Manual finish (push-button switch-closure activated by a finish official).

These signals are scanned by the computer for "coincidence" timing. For example, if an automatic start signal (from a wand) and a manual start signal (push-button) are received within a predetermined time window of each other (i.e., one second), the time when the automatic start signal occurred is used as the "start time" and defined and identified as "coincident". If the automatic and manual times are not "coincident", the time when the automatic signal occurred is used as the start time. The same procedure is used for the finish time using the automatic finish switch and the manual finish switch.

Because dual start and finish signals are coupled into coincidence sampling, the chances of lost times are greatly reduced over previous timing methods. Also, both the start and finish times are more reliable because the "coincidence" time is the automatic time that has occurred within, for example, a 1-second window before or after the manual time occurred.

Once the contestant has passed the finish line, the finish-time is manually coupled on the display by the operator to the contestant's start time. The computer calculates a raw elapsed time. Penalty points, if any, are then manually entered by the computer operator to give the total race time or score. As seen in FIG. 4, this time is displayed in seconds (xxxx.xx).

All keystrokes are verified with the column that the cursor is in, in order to prevent illegal entries. For instance, only numerals and spaces are allowed in BIB number fields.

Referring to FIG. 5, the manual start time is printed when the manual start signal is received. This is the same for automatic start, manual finish, and automatic finish when the corresponding signals are received. When finish time are transferred to contestant lines, the finish time and corresponding BIB number are printed. The start time and corresponding BIB number are printed when the start time is verified with the F3 entry.

If a change is made to the start or finish times, when in Full-Screen-Edit mode, the line where the changes was made is printed.

"Coincidence time" is defined as when the automatic and manual signals occur within a specified window of time (1 second in the example). The automatic switch time is then used for calculating the elapsed time which is identified as "coincident". For instance, if an automatic switch signal is received, and the manual signal is received in the next 1 second, the automatic time is used and marked "C". If a manual signal is received, and the automatic switch signal is received within the next 1 second, the automatic switch time is used and marked "C. If a manual signal is received alone, without the automatic switch signal, then the manual time is used and marked "M". The same is applied to the automatic time and is received alone without the manual switch signal following in 1 second. If automatic times are used to calculate elapsed time, it is marked "A".

Several contestants from different race classes can be on the course at the same time. The computer keeps track of the start, elapsed time, finish time, penalty points, and overall time of each contestant. A total of 250 contestants can be timed in any single event. Informtion is saved on a disk which allows race suspensions and continuations if necessary. Information may also be transmitted through a serial port to another computer for further processing.

The preferred embodiment and best mode of the invention has been disclosed. The invention has been described in the context of a white water slalom race. It will be appreciated that variations will apparent to those skilled in the art. Therefore, the scope of the invention is to be determined by the claims which will be found after the following software listing.

```
; WHITEWATER SLALOM TIMING        Wausau, Wisconsin        V3.1

;       Don Picuff  01/26/88

;         Copyright © 1988 GTE NORTH Inc.    All rights reserved

;                                  Property of GTE
;                 Unlawful to copy without written permission from GTE

;                                                    DB37
;                                              Bit   pin
STACK     SEGMENT   PARA STACK 'STACK'         ; 7    3     Finish - Manual
          DB        256 DUP(0FFH)              ; 6    4     Start  - Manual
STACK     ENDS                                 ; 5    5     Finish - Auto
;                                                4    6     Start  - Auto
;                                                        21    Gnd
;                                                        18    +5  pull up
;                                                  [Gnd when closed];
DATA      SEGMENT   PARA PUBLIC 'DATA'

port              dw      201h              ;PIA  1 off    2-8 on
sample_flag       db      1        ;0 - no sampling     1 - yes

adj_flag          db      0
adr_6845          dw      0
ajunk1            dw      '00'

auto_finish_time  db      "__:__.__"
auto_finish_timer db      0
auto_fin_timer0   dw      0

auto_start_time   db      "__:__.__"
auto_start_timer  db      0
auto_st_timer0    dw      0

attr_race_num     db      0dh               ;lite mag
attr_last_name    db      71h               ;blue on grey

baud_rate_code    db      60h               ;60h-1200  30h-2400
bib               db      3 dup(0)
bib_si            dw      0
beep_tone         dw      5000
calc_row          dw      0
col_start_flag    db      0
closed            db      'CLOSED'
cmd1              db      'Start new race? (Y/N) $'
cmd2              db      'Are you sure?  (Y/N) $'
```

```
color_flag      db      0
col             dw      0
;                           Legal cursor columns
cols            db      0,1,2,4,6,7,8,10,11,12,13,14,15,16,17,18,19,21,31,49
                db      50,51,61,62,63,65,66,67
cols_e          db      00,01,02,04,06,07,08,10,11,12,13,14,15,16,17,18,19,21
                db      22,23,24,25,26,27,28,29,31,32,33,34,35,36,37,38,39,49
                db      50,51,61,62,63,65,66,67
                db      0
cols_bibf       db      61,62,63,65,66,67
cols_fin        db      31      ;Legal finish column for "DNF" or "DNR"
cols_pen        db      49,50,51   ;Penalty pt cols
cols_st         db      21      ;Legal start col
col_fin         dw      69      ;Beginning column on screen for finish times
col_ptr         dw      0
col_ptr_e       dw      0
col_ptr_max     dw      27      ;Max # of legal cursor columns
col_ptr_max_e   dw      43
col_start       dw      21      ;Beginning column on screen for start times
com_load_ptr    dw      0
com_unload_ptr  dw      0
CR              db      0dh
current_tone    dw      0
date            db      '__/__/__$'
delete_col_st   dw      0
delete_num      dw      0
display_flag    db      0
div_10          db      10
div_60          db      60
div_80          db      80
div_100         db      100
div_1000        dw      1000
dnf_string      db      " -DNF-  "
dnr_string      db      " -DNR-  "
dsec            dw      0
edit_flag       db      0       ;not implemented
end1            dw      0
end_msg_1       db      "Saving results to disk... $"
end_msg_3       db      "END NOW? $"
error_flag      db      0
err_msg_1       db      "Insufficient memory for system$"
err_msg_2       db      "Printer not installed / not responding$"
err_msg_3       db      "Printer overflow$"
err_msg_4       db      "Printer fault$"
err_msg_5       db      "Cannot create disk file$"
err_msg_6       db      "FINISH OVERFLOW$"
err_msg_7       db      "START OVERFLOW$"
err_msg_8       db      " DISK ERROR $"
err_msg_9       db      '  Cannot find old race file "RACEOUT1"  $'
err_msg_10      db      "  Data error in old race file.  Hit any key to"
                db      " continue.  $"
err_msg_11      db      '*** Illegal date ***$'
err_msg_12 db 'COM1 hardware not found.  Hit any key to acknowledge..$'

exit_flag       db      0
file_handle     dw      0
fin_si          dw      0
fn_en_tone      dw      1000
fse_row         db      0
fse_screen_st   db      0
get_time_counter dw     0
GTE             db      " GTE "
gte_1           db      "         Timing by GTE$"
hours           db      0
iii_col         db      " Iii-col"
iii_space       db      " Iii-spc"
keyin_code      db      0
LF              db      0ah
manual          db      0
```

```
manual_finish_time   db   "__:__:__"
manual_finish_timer  db   0
manual_fin_timer0    dw   0

manual_start_time    db   "__:__:__"
manual_start_timer   db   0
manual_st_timer0     dw   0

match_loc            dw   0
match_row            dw   0
msec                 db   0
no_copy              db   "NO-COPY "
no_match             db   "NO-MATCH"
no_time              db   "NO-TIME"
no_xfer              db   " NO-XFER"
num_page_locs        dw   2        ;# of page locs for numbers
open                 db   " OPEN "
outfile              db   'raceout1    ',0
outfilebak           db   'raceout1.bak',0
over_flow            db   " OVER "
over_999             db   "9999.99"

pop_lines            dw   13       ;# of line in pop_up
pop_start            dw   4*160+50 ;Start of pop-up screen
pt_adpt              dw   0
pt_err_flag          db   0
pt_finish_string1 db      '** Manual FINISH  '
pt_finish_string2 db      'Automatic FINISH  '
pt_load              dw   0
pt_start_string1 db       '** Manual START   '
pt_start_string2 db       'Automatic START   '
pt_unload            dw   0
records              dw   0
row                  db   3
row_fin              db   0        ;Row for next finish time in image area
screen1              dw   50*2             ;Loc to print time
screen_st            db   0
screen_st_max        dw   250-21
sec1                 db   0
sec10                db   0
sec20                db   0
sec5                 db   0
secs                 db   0
set_string1          db   "Set/verified start time  $"
start_sl             dw   0
st_en_tone           dw   2000
temp                 dw   0
temp1                db   0
temp2                db   0
time                 db   '__:__:__.__$'
time1                db   '__:__.__$'
timer1               db   0
timer2               db   0
timer_display        db   0
timer_help           db   0
timer_tone           db   0
title1               db   '**  T E S T  **$'
title2 db 'AUTOMATIC - MANUAL START Switches    AUTOMATIC - MANUAL FINISH'
       db ' Switches$'
title3               db   'Press any key to finish test$'
total1               db   '      '
total2               db   '      '
tsec                 dw   0
uart                 dw   03f8h    ;COM1
video_adpt           dw   0
xfer_string1         db   'Transfered finish time  $'
```

```
help_screen_1   db      "$"
                db      34 dup (0dch),"$"
                db      " WHITEWATER SLALOM TIMING SYSTEM $"
                db      "     Initially Prov dec for      $"
                db      "        Wausau, Wisconsin        $"
                db      "              $"

help_2          db      0c9h,29 dup (0cdh), 0bbh, '$'
                db      0bah,'F1  This HELP screen          ',0bah,'$'
                db      0bah,'F2  XFER finish time          ',0bah,'$'
                db      0bah,'F3  Set Start Time            ',0bah,'$
                db      0bah,'F4  Duplicate Class on Start  ',0bah,'$'
                db      0bah,'F5                            ',0bah,'$'
                db      0bah,'F6  TEST                      ',0bah,'$'
                db      0bah,'F7  Update data on disk       ',0bah,'$'
                db      0bah,'F8  Mark "DNF"                ',0bah,'$'
                db      0bah,'F9  Recalculate               ',0bah,'$'
                db      0bah,'F10 Mark "DNR"                ',0bah,'$'
                db      0bah,'Esc Esc -> Exit               ',0bah,'$'
                db      0c8h,29 dup (0cdh), 0bch, '$%'

screen_top  db '        WHITEWATER SLALOM TIMING  V3.1
            db '                    '
    db '--- - --- ---------- --------- --------- ------- --- ------- --- --- '
    db '---------  '
    db 'CL# R BIB Last Name    START    FINISH     TIME  PEN  TOTAL  BIB BIB '
    db 'Finishes   '

screen_area_size dw     253*80
screen_area     dw      253*80 dup(720h)
screen_area_end dw      0

dta             db      255*80 dup(' ')

PT_BUFR_SIZE    dw      500
pt_buffer       db      500 dup('p')

COM_BUFFER_SIZE dw      1000
com_buffer      dw      1000 dup('c')

DATA    ENDS


;&&
CODE    SEGMENT  PARA PUBLIC 'CODE'
START   PROC FAR

        assume  cs:code
        push    ds
        mov     ax,0
        push    ax
        mov     es,ax
        mov     ax,data
        mov     ds,ax
        assume  ds:data

        call    start_up
        cmp     error_flag,1
        jne     m5
        jmp     exit3

m5:     call    display_blue_border
        call    uart_init
        nop
        nop


; @@@@@@@@@@@@@@@@@  Main loop  @@@@@@@@@@@@@@@@@
```

```
m10:    call    get_date_time
        call    sample_switches  ;Sample start & finish switches all the time
        call    keyin
        call    print_it         ;Print 1 char from printer buffer
        call    com_out          ;outputs 1 char to com if uart ready
        cmp     exit_flag,1
        je      exit
        cmp     display_flag,1
        jne     m11
        call    cursor
        call    screen_refresh

m11:    cmp     sec1,1
        jl      m40
        mov     sec1,0
        call    display_dt

m40:    cmp     sec20,20
        jne     m50
        mov     sec20,0
        call    screen_refresh

m50:    jmp     m10

exit:   call    clear_screen
        mov     display_flag,0
        mov     exit_flag,0
        call    end_up
        cmp     display_flag,1
        je      m10

exit1:  nop

exit2:  call    clear_screen
        call    tone_off
exit3:  mov     row,24
        mov     col,0
        call    cursor
        ret

;-----------------------------------------


;----- BOOP -----
boop    proc    near            ;Beep speaker to indicate something illegal
        mov     bx,boop_tone
        call    tone_on
        mov     timer_tone,1    ;about .05 secs
        ret
boop    endp


;-----CALC1 -----
calc1   proc    near    ;Det. run time, subtracts penalty, calc adj totals
        mov     si,bx   ;  for run group starting at bx    (97)

;  Ck for start time existence  -  No start - no calc
        lodsb
        dec     si
        cmp     al,' '
        jne     c20
        ret

c20:    mov     start_si,si
```

```
;  CK for finish time existence
        add     si,10*2
        push    si
        add     si,4
        lodsb
        pop     si
        cmp     al,':'
        je      c30
        cmp     al,'0'          ;DNF - make finish time 777.77
        jne     c25
        jmp     calc1_err
c25:    ret                     ;No finish - no calc

c30:    push    si              ;Save finish time col
        mov     si,start_si
        call    time_to_secs    ;Convert time to tsec/dsec
        mov     cx,tsec
        mov     dx,dsec
        pop     si              ;recover finish time col
        call    time_to_secs

;  Calc run time
        cmp     dsec,dx         ;EX:   fin = 12:10.02 = tsec, dsec
        jge     c50             ;       st = 10:12.61 = cx  , dx
        add     dsec,100
        cmp     tsec,0
        je      c40
        mov     tsec,3601
c40:    dec     tsec
c50:    sub     dsec,dx
        cmp     tsec,cx
        jge     c60
        add     tsec,3600
c60:    sub     tsec,cx

;  Sub total seconds
        cmp     tsec,3600
        jb      c100
        jmp     calc1_err
c100:   mov     di,si           ;finish time col
        add     di,10*2
        mov     ax,offset screen_area
        sub     di,ax

        mov     dx,0
        mov     ax,tsec
        div     div_1000        ;Quot in ax  Rem in dx
        mov     cx,dx
        mov     dx,0
        mov     ah,0bh          ;cyan
        cmp     al,0
        jne     c105
        mov     al,' '
        jmp     c106
c105:   add     al,'0'
        mov     dx,1            ;No more leading spaces in #
c106:   mov     [screen_area + di],ax
        add     di,2
        mov     ax,cx
        div     div_100         ;Quot in al  Rem in ah
        mov     cx,0
        mov     cl,ah
        mov     ah,0bh          ;cyan
        cmp     dx,1
        je      c110
        cmp     al,0
        jne     c110
        mov     al,' '
        jmp     c111
```

```
c110:   add     al,'0'
        mov     dx,1            ;No more leading spaces in #
c111:   mov     [screen_area + di],ax
        add     di,2
        mov     ax,cx
        div     div_10
        mov     cl,ah
        mov     ah,0bh          ;cyan
        cmp     cx,1            ;Leading spaces?
        je      c120
        cmp     al,0
        jne     c120
        mov     al,' '
        jmp     c121
c120:   add     al,'0'
c121:   mov     [screen_area + di],ax
        add     di,2
        mov     al,cl
        add     al,'0'
        mov     [screen_area + di],ax
        add     di,2
        mov     al,'.'
        mov     [screen_area + di],ax
        add     di,2

;  Sub-total hundreds secs
        mov     ax,csec
        div     div_10
        mov     cx,0
        mov     cl,ah
        mov     ah,0bh
        add     al,'0'
        mov     [screen_area + di],ax
        add     di,2
        mov     al,cl
        add     al,'0'
        mov     [screen_area + di],ax
        add     di,2

;  Get penalty points
        add     si,18*2         ;SI points to pen start
        mov     ax,0
        mov     temp,0

        lodsb
        cmp     al,' '
        je      c150
        sub     al,'0'
        mov     dx,100
        mul     dx
        mov     temp,ax
c150:   mov     ax,0
        inc     si
        lodsb
        cmp     al,' '
        je      c160
        sub     al,'0'
        mov     dx,10
        mul     dx
        add     temp,ax
c160:   mov     ax,0
        inc     si
        lodsb
        cmp     al,' '
        je      c170
        sub     al,'0'
        add     temp,ax
c170:   inc     si

;  Add penalty points
        mov     ax,temp
```

```
        add     tsec,ax
        cmp     tsec,9999
        jb      c200
        add     di,5*2
        jmp     c505

;  Adjusted total secs
c200:   add     di,5*2
        mov     ax,tsec
        mov     dx,0
        div     div_1000        ;Quot in ax  Rem in dx
        mov     cx,dx
        mov     dx,0
        mov     ah,70h
        cmp     al,0
        jne     c205
        mov     al,' '
        jmp     c206
c205:   add     al,'0'
        mov     dx,1            ;No more spaces in #
c206:   mov     [screen_area + di],ax
        add     di,2
        mov     ax,cx
        div     div_100         ;Quot in al  Rem in ah
        mov     cx,0
        mov     cl,ah
        mov     ah,70h
        cmp     dx,1
        je      c210
        cmp     al,0
        jne     c210
        mov     al,' '
        jmp     c211
c210:   add     al,'0'
        mov     dx,1            ;No more spaces in #
c211:   mov     [screen_area + di],ax
        add     di,2
        mov     ax,cx
        div     div_10
        mov     cl,ah
        mov     ah,70h
        cmp     dx,1            ;Leading spaces
        je      c220
        cmp     al,0
        jne     c220
        mov     al,' '
        jmp     c221
c220:   add     al,'0'
c221:   mov     [screen_area + di],ax
        add     di,2
        mov     al,cl
        add     al,'0'
        mov     [screen_area + di],ax
        add     di,2

;  Copy ".xx" from sub total
        sub     si,7*2
        mov     ax,offset screen_area
        add     di,ax
        push    es
        mov     ax,data
        mov     es,ax
        mov     cx,3
        mov     ah,70h
c300:   lodsb
        inc     si
```

```
        stosw
        loop    c300
        pop     es
        ret

;  Overflow errors
calc1_err: mov  di,si           ;finish time col
        add     di,10*2
        mov     si,offset over_999      ;"9999.99"
        mov     ax,offset screen_area
        sub     di,ax           ;di = dist into scrn area
        mov     ah,0bh          ;cyan
        mov     cx,7
c500:   lodsb
        mov     [screen_area + di],ax
        add     di,2
        loop    c500
        add     di,5*2
c505:   mov     ah,70h          ;inverse
        mov     cx,7
        mov     si,offset over_999
c510:   lodsb
        mov     [screen_area + di],ax
        add     di,2
        loop    c510
        ret
calc1   endp


;----- CALC ASCII TO NUMBER -----
calc_a2n proc near              ;si = start of 2-dig ascii string
        push    dx
        push    si
        mov     ax,0
        lodsb
        sub     al,'0'
        mov     dx,10
        mul     dx
        mov     temp,ax
        inc     si
        mov     ax,0
        lodsb
        sub     al,'0'
        add     ax,temp
        pop     si
        pop     dx
        ret
calc_a2n endp


;----- CALCULATE TOTALS -----
calc_totals     proc    near    ;Calc run times & adjusted times
        mov     calc_row,0
ct10:   mov     bx,offset screen_area
        mov     ax,calc_row
        mov     dx,160
        mul     dx
        add     bx,ax
        push    bx
        mov     ax,col_start            ;Begin at start time
        shl     ax,1    ;*2
        add     bx,ax
        call    calc1
        pop     bx
        inc     calc_row
        cmp     calc_row,250
```

```
        jz      ctlc
        ret
calc_totals     endp

;----- CLEAR SCREEN -----
clear_screen proc  near
        mov     cx,2000
        mov     di,0
        mov     ax,720h
        rep     stosw
        ret
clear_screen endp

;----- COM BUFFER LOAD -----
com_bufr_ld  proc  near         ;AL has char   regs not changed
        push    bx
        mov     bx,com_load_ptr
        mov     byte ptr[com_buffer + bx],al
        inc     bx
        cmp     bx,COM_BUFFER_SIZE
        jb      cb10
        mov     bx,0
cb10:   cmp     bx,com_unload_ptr
        je      cb20
        mov     com_load_ptr,bx
cb20:   pop     bx
        ret
com_bufr_ld  endp

;----- COM OUTPUT -----
com_out  proc  near
        mov     bx,com_unload_ptr
        cmp     bx,com_load_ptr
        jne     co10
        ret
co10:
        mov     dx,uart         ;ck for trans holding reg ready
        add     dx,5
        in      al,dx
        test    al,20h          ;Bit 5
        jnz     co20
        ret                     ;not ready
co20:   mov     al,byte ptr[com_buffer + bx]
        sub     dx,5
        out     dx,al
        inc     bx
        cmp     bx,COM_BUFFER_SIZE
        jb      co30
        mov     bx,0
co30:   mov     com_unload_ptr,bx
        mov     word ptr es:[158],7001h ;screen indicator
        ret
com_out  endp

;----- CURSOR -----
cursor  proc    near            ;Update cursor loc on screen per row & col
        mov     al,80
        mul     row
        add     ax,col
        mov     bx,ax
        mov     dx,adr_6845
        mov     al,14
        out     dx,al
```

```
        mov     al,cl
        out     dx,al
        dec     dx
        mov     al,15
        out     dx,al
        inc     dx
        mov     al,bl
        out     dx,al
;  update dos cursor loc
        push    es
        mov     ax,0
        mov     es,ax
        mov     ax,col
        dec     ax
        mov     ah,row
        dec     ah
        mov     es:[450h],ax
        pop     es
        ret
cursor  endp


;----- CURSOR UPDATE -----
cursor_update   proc    near
        cmp     ah,75           ;Left arrow?
        je      cu10
        cmp     ah,77           ;Right arrow?
        je      cu11
        cmp     ah,72           ;Up arrow?
        je      cu12
        cmp     ah,80           ;Down arrow?
        je      cu13
        cmp     ah,71           ;Home?
        je      cu14
        cmp     ah,79           ;End key?
        je      cu15
        cmp     ah,73           ;PgUp?
        je      cu16
        cmp     ah,81           ;PgDn?
        je      cu17
        ret

cu10:   jmp     cu100           ;Left
cu11:   jmp     cu150           ;Right
cu12:   jmp     cu300           ;Up
cu13:   jmp     cu400           ;Down
cu14:   jmp     cu500           ;Home
cu15:   jmp     cu550           ;End of screen
cu16:   jmp     cu600           ;PgUp - up 15 lines
cu17:   jmp     cu700           ;PgDn - down 15 lines

;  Left arrow
cu100:
        cmp     edit_flag,1
        je      cu200
        cmp     col_ptr,0       ;Cursor already left?
        jne     cu110
        ret                     ;No wrap arraound
cu110:  dec     col_ptr
        jmp     cu180

;  Right arrow
cu150:
        cmp     edit_flag,1
        je      cu250
```

```
        mov     bx,col_ptr          ;Cursor already at right?
        cmp     bx,col_ptr_max
        jl      cu170
        ret                         ;No wrap arround
cu170:  inc     col_ptr

cu180:  mov     bx,col_ptr
        mov     ax,0
        mov     al,[cols + bx]
        mov     col,ax
        call    cursor
        ret

;  Left arrow - FS EDIT

cu200:  cmp     col_ptr_e,0         ;Cursor already left?
        jne     cu210
        ret                         ;No wrap arrearound
cu210:  dec     col_ptr_e
        jmp     cu280

;  Right arrow - FS EDIT
cu250:  mov     bx,col_ptr_e        ;Cursor already at right?
        cmp     bx,col_ptr_max_e
        jl      cu270
        ret                         ;No wrap arrcund
cu270:  inc     col_ptr_e

cu280:  mov     bx,col_ptr_e
        mov     ax,0
        mov     al,[cols_e + bx]
        mov     col,ax
        call    cursor
        ret

;  Up arrow
cu300:  cmp     row,3               ;Already at top?
        jle     cu310
        dec     row
        call    cursor
        call    print_fse_row
        ret
cu310:  mov     row,3               ;Reinforce it
        cmp     screen_st,0         ;At top in image area
        jne     cu320
        ret
cu320:  dec     screen_st
        call    print_fse_row
        mov     display_flag,1
        ret

;  Down arrow
cu400:  cmp     row,24              ;Already at bottom?
        jge     cu410
        inc     row
        call    cursor
        call    print_fse_row
        ret
cu410:  mov     row,24              ;Reinforce it
        mov     bx,0
        mov     bl,screen_st
        cmp     bx,screen_st_max
        jb      cu420
        ret                         ;Already at bottom of image scrn area
cu420:  inc     screen_st
        call    print_fse_row
```

```
        mov     display_flag,1
        ret

;  Home
cu500:  mov     row,3
        mov     col,0
        mov     col_ptr,0
        mov     col_ptr_e,0
        mov     screen_st,0
        call    print_fse_row
        mov     display_flag,1
        ret

;  End of screen
cu550:  mov     row,24
        mov     col,0
        mov     col_ptr,0
        mov     col_ptr_e,0
        call    print_fse_row
        mov     display_flag,1
        ret

;  PgUp - Up 15 lines
cu600:  cmp     screen_st,15
        ja      cu610
        mov     screen_st,0
        call    print_fse_row
        mov     display_flag,1
        ret
cu610:  sub     screen_st,15
        call    print_fse_row
        mov     display_flag,1
        ret

;  PgDn - Down 15 lines
cu700:  mov     bx,0
        mov     bl,screen_st
        add     bx,15
        cmp     bx,screen_st_max
        ja      cu710
        mov     screen_st,bl
        call    print_fse_row
        mov     display_flag,1
        ret
cu710:  mov     bx,screen_st_max
        mov     screen_st,bl
        call    print_fse_row
        mov     display_flag,1
        ret
cursor_update endp


;----- DELETE ENTRY -----
delete_entry    proc near       ;Ck legal delete cols / Finish entries only
        mov     ax,0
        mov     al,screen_st
        add     al,row
        sub     al,3
        mov     dx,160
        mul     dx              ;ROWI = (SCREEN_ST + ROW - 3) * 160
        mov     di,delete_col_st
        shl     di,1            ;* 2 for word
        add     di,ax

de20:   mov     ax,720h         ;Blank space
        mov     cx,delete_num
```

```
de30:   mov     [screen_area + di],ax
        add     di,2
        loop    de30
        mov     display_flag,1
        ret
delete_entry    endp

;----- DELETE ENTRY CHECK -----
delete_entry_ck  proc   near    ;Ck legal cols / determine start & # blanks
;  Ck finish and start cols
        mov     ax,0
        mov     al,cols_fin
        mov     delete_num,29
        mov     delete_col_st,ax        ;finish col
        cmp     ax,col
        je      dckout

;  Ck start col
        mov     delete_num,39
        mov     al,cols_st
        mov     delete_col_st,ax        ;start col
        cmp     ax,col
        je      dckout

;  Ck penalty cols
        mov     cx,3
        mov     si,0
        mov     delete_num,29
        mov     delete_col_st,31
dck10:  mov     al,[cols_pen + si]
        inc     si
        cmp     ax,col
        je      dckout
        loop    dck10

;  Ck finish BIB# cols
        mov     cx,6
        mov     si,0
        mov     delete_num,11
        mov     delete_col_st,69        ;finishes start col
dck30:  mov     al,[cols_bib# + si]
        inc     si
        cmp     ax,col
        je      dckout
        loop    dck30
        cmp     col,64          ;col between finish BIB#s
        je      dckout

        mov     keyin_code,0
        call    display_blue_border
        call    boop            ;Illegal col.
dckout: ret
delete_entry_ck  endp


;----- DISPLAY -----
display proc near       ;SI starts string terminated by '$'
d10:    lodsb           ;DI has screen location;  AH has attribute
        cmp     al,'$'
        je      d20
        stosw
        jmp     d10
d20:    ret
display  endp
```

```
;----- DISPLAY BORDERS -----
display_blue_border     proc near
        push    ax
        push    dx
        mov     dx,3d9h
        mov     al,1
        out     dx,al
        pop     dx
        pop     ax
        ret
display_blue_border     endp

;----- DISPLAY DATE & TIME -----
display_dt      proc near
        mov     si,offset date
        mov     di,screen1              ;Loc to print time
        mov     ah,70h                  ;Inverse
        call    display
        add     di,2
        mov     si,offset time
        call    display
        ret
display_dt  endp

;----- DISPLAY HELP SCREEN -----
display_help_screen  proc  near
        mov     dx,pop_start            ;Upper left corner of pop-up
        mov     cx,pop_lines            ;# of lines
        mov     si,offset pop_up1
        mov     ah,60h                  ;Black on brown
dhs5:   mov     di,dx
        call    display
        add     dx,160                  ;Next line
        loop    dhs5
        mov     timer_help,5            ;5 secs max
dhs20:  call    sample_switches
        call    get_date_time
        cmp     timer_help,0
        je      dhs30
        mov     ah,1                    ;Check for keyin
        int     16h
        jz      dhs20
        mov     ah,0                    ;Get keyin char
        int     16h
dhs30:  mov     display_flag,1
        ret
display_help_screen  endp

;----- DUPLICATE CLASS OR START NUMBER -----
dup_class_start_number  proc    near
        mov     si,col
        cmp     si,0            ;Cols 1, 2, 3
        je      du30
        cmp     si,1
        jne     du10
        dec     si
        jmp     du30
du10:   cmp     si,2
        jne     du12
        sub     si,2
        jmp     du30
du12:   cmp     si,4
```

```
        jne     du15
        sub     si,4
        jmp     du30
du15:   cmp     si,col_start
        jne     du20
        mov     col_start_flag,1
        jmp     du30

du20:   call    beep
        mov     si,offset ill_col       ;"ILL-COL"
        jmp     duerr1

;  ck for blank position below cursor
du30:   shl     si,1
        mov     ah,0
        mov     al,screen_st
        add     al,row
        sub     al,3
        mov     dx,160
        mul     dx
        add     si,ax           ;cur loc
        add     si,offset screen_area
        mov     di,si
        add     di,160          ;place to copy class #

        mov     al,byte ptr[di]
        cmp     al,' '
        jne     du100
        mov     al,byte ptr[di+2]
        cmp     al,' '
        jne     du100
        mov     al,byte ptr[di+4]
        cmp     al,' '
        jne     du100

;  copy class & race # or start time
        push    es
        mov     ax,data
        mov     es,ax
        mov     cx,5            ;class & race #s
        cmp     col_start_flag,1
        jne     du70
        mov     cx,9
        mov     col_start_flag,0
du70:   rep     movsw
        pop     es
        mov     ah,80           ;down arrow
        call    cursor_update
        mov     display_flag,1
        ret

du100:  call    beep
        mov     si,offset no_copy
duerr1: mov     ah,0
        mov     al,row
        mov     dx,160
        mul     dx
        mov     di,ax
        mov     ah,8fh          ;flash intense
        mov     cx,8
due10:  lodsb
        stosw
        loop    due10
        ret
dup_class_start_number  endp
```

```
;----- GET DATE & TIME -----   SFD
get_date_time proc near;CH = Hours  CL = Minutes  DH = Secs  DL = 1/100 sec
        mov     ah,2ch          ;Function call to get time
        int     21h
        cmp     dl,msec
        jne     st00
        inc     get_time_counter
        ret

; ----  55 MILLISECOND LOOP ----
st00:   mov     msec,dl
        call    timecon         ;Convert to 2-byte ASCII string
        mov     [time + 9],al
        mov     [time +10],ah

        push    dx
        push    cx
        call    test_coinc      ;test for coincidence start & finish signals
        pop     cx
        pop     dx

st3:    cmp     auto_finish_timer,0     ;55 msec timers
        je      st3a
        dec     auto_finish_timer
st3a:   cmp     manual_finish_timer,0
        je      st3b
        dec     manual_finish_timer
st3b:   cmp     auto_start_timer,0
        je      st3c
        dec     auto_start_timer
st3c:   cmp     manual_start_timer,0
        je      st3d
        dec     manual_start_timer
st3d:

        cmp     timer_tone,0    ;test for tone on for timer_tone * 55 msec
        je      st4
        dec     timer_tone      ;shut off when it goes to zero
        cmp     timer_tone,0
        jne     st4
        call    tone_off
st4:
        cmp     dh,secs         ;Seconds changed?
        jne     st5
        mov     get_time_counter,0
        ret

;  ---- 1 SECOND LOOP ----
st5:

;displays # of times this loop is run every 55 ms
  JMP GT5a
        mov     ax,get_time_counter
        div     div_10          ;AL has quot, rem in ah
        add     al,'0'
        mov     byte ptr ES:[156],al
        add     ah,'0'
        mov     byte ptr ES:[158],ah
        mov     get_time_counter,0
GT5a:
        inc     sec1
        inc     sec20
        cmp     timer1,0
        jz      st6
        dec     timer1
```

```
gt5:    cmp     timer2,0
        jz      gt7
        dec     timer2
gt7:    cmp     timer_help,0
        jne     gt7a
        dec     timer_help
gt7a:   cmp     timer_display,0
        je      gt8
        dec     timer_display
        cmp     timer_display,0
        jne     gt8
        mov     display_flag,1
gt8:

gt10:   mov     secs,dh
        mov     dl,dh           ;Seconds
        call    timecon
        mov     [time + 6],al
        mov     [time + 7],ah
        mov     dl,cl           ;Minutes
        call    timecon
        mov     [time + 3],al
        mov     [time + 4],ah
        mov     dl,ch           ;Hours
        call    timecon
        mov     time,al
        mov     [time + 1],ah
        cmp     ch,hours
        jne     gt20
        ret

;  Update date every hour
gt20:   mov     hours,ch
        mov     ah,2ah          ;Dos function call for data
        int     21h             ;CX = Year  DH = Month  DL = Day
        call    timecon
        mov     [date + 3],al
        mov     [date + 4],ah
        mov     dl,dh           ;Month
        call    timecon
        mov     date,al
        mov     [date + 1],ah
        cmp     cx,1999         ;Year > 1999 ?
        jne     gt40
        sub     cx,2000
        mov     dl,cl
        call    timecon
        mov     [date + 6],al   ;Year > 1999
        mov     [date + 7],ah
        ret
gt40:   sub     cx,1900
        mov     dl,cl
        call    timecon
        mov     [date + 6],al   ;Year < 2000
        mov     [date + 7],ah
        ret
get_date_time endp


;----- KEYIN -----  719
keyin proc near;Scan kybd for input
;  Check for struck key
        mov     ah,1            ;Ck if key has been struck
        int     16h             ;ZF=0 if key was struck
        jnz     k00
        ret
```

```
;  Get ASCII character & scan code
k00:    mov     ah,0
        int     16h

k10:
        call    display_blue_border

        cmp     keyin_code,1    ;Waiting on keyin?
        jne     k15
k15:    cmp     keyin_code,2
        jne     k20
k20:    cmp     keyin_code,3
        jne     k25
        jmp     k53
k25:    cmp     keyin_code,4
        jne     k35
        jmp     k56
k35:    nop

        jmp     k90

k53:    cmp     ah,1            ;ESC the 2nd time?
        je      k53a
        mov     keyin_code,0
        ret
k53a:   mov     exit_flag,1
        ret

k56:    cmp     ah,74           ;" - " 2nd time?
        je      k56a
        mov     keyin_code,0
        ret
k56a:   call    delete_entry    ;Takes 2 " - " in a row to delete entry
        mov     display_flag,1
        mov     keyin_code,0
        ret

k90:    cmp     ax,0f09h        ;TAB
        jne     k91
        call    process_tab
        ret

k91:    cmp     ah,16           ; delete arrow
        jne     k92
        mov     ah,75
        call    cursor_update
        ret
k92:
k100:   cmp     ah,74           ;" - " - Delete entry
        jne     k101
        mov     keyin_code,4
        mov     dx,3d9h
        mov     al,0ch          ;Light Red
        out     dx,al
        call    delete_entry_ck ;ck legal cols
        ret

k101:   cmp     ah,71           ;Cursor keys
        jl      k102
        call    cursor_update
        ret

k102:
k103:   cmp     ah,3bh          ;F1 - HELP  (3b)
        jne     k105
        call    display_help_screen
```

```
        call    display_blue_border
        ret

k105:   cmp     ah,3ch          ;F2 - XFER Finish Time
        jne     k110
        call    xfer_finish_time
        call    sample_switches
        call    calc_totals
        ret

k110:   cmp     ah,3dh          ;F3 - Set Start Time
        jne     k120
        call    set_start_time
        ret

k120:   cmp     ah,3eh          ;F4 - Duplicate class#
        jne     k130
        call    dup_class_start_number
        ret

k130:   cmp     ah,3fh          ;F5

k140:   cmp     ah,40h          ;F6 - TEST
        jne     k150
        call    test_ports
        ret

k150:   cmp     ah,41h          ;F7 - Write data to disk
        jne     k160
        call    write_race_file
        ret

k160:   cmp     ah,42h          ;F8 - Mark DNF
        jne     k170
        call    mark_dnf
        ret

k170:   cmp     ah,43h          ;F9 - Recalc
        jne     k180
        call    calc_totals
        mov     display_flag,1
        ret

k180:   cmp     ah,44h          ;F10 - Mark DNR
        jne     k190
        call    mark_dnr
        ret

k190:   cmp     ax,1200h        ;Alt-E  Full-screen edit (not implemented)
        jne     k200
        mov     col,0
        mov     col_ptr,0
        mov     col_ptr_e,0
        call    cursor
        cmp     edit_flag,1
        jne     k191
        mov     edit_flag,0
        call    print_fse_row
        mov     display_flag,1
        ret
k191:   mov     edit_flag,1
        mov     fse_row,0
        mov     display_flag,1
        ret
k200:
```

```
k400:   cmp     ah,28           ;RetUrn
        jne     k410
        mov     col,0           ;Cursor to left col of screen
        mov     col_ptr,0
        mov     col_ptr_e,0
        mov     ah,80           ;Move cursor down 1 row
        call    cursor_update
        ret

k410:   cmp     ah,1            ;ESC - Prepare for exit
        jne     k500
        mov     keyin_code,3
        ret

k500:   call    process_keyin   ;Get input #, edit, test legal col, place.
        call    calc_totals
        ret
keyin endp


;----- LOAD RACE FILE -----
load_race_file  proc near
        mov     dx,offset outfile
        mov     al,2            ;read & write attribute
        mov     ah,3dh          ;open
        clc
        int     21h
        jnc     l10             ;no carry if opened or created OK

;  disk error - cannot create file
        mov     si,offset err_msg_9  ;"Cannot find old race file ...
        mov     di,21*160 + 21*2
        mov     ah,70h
        call    display
        mov     error_flag,1
        ret

l10:    mov     file_handle,ax
        mov     bx,ax

;  Load old race data to disk transfer area
        mov     dx,offset dta
        mov     cx,250*80       ;# of bytes to read
        mov     al,2            ;read/write attribute
        mov     ah,3fh          ;read
        int     21h
        mov     bx,ax           ;# of byte read

        push    bx
        mov     bx,file_handle
        mov     ah,3eh          ;close file
        int     21h
        pop     bx

;  Move chars to screen image area
        push    es
        mov     ax,data
        mov     es,ax
        mov     si,offset dta
        mov     di,offset screen_area
        mov     dx,0
ld20:   mov     cx,78
ld30:   movsb
        inc     di              ;skip attribute
        loop    ld30
        lodsb
```

```
        cmp     al,cr
        jne     lderr
        lodsb
        cmp     al,LF
        jne     lderr
        add     di,4
        add     dx,80
        cmp     dx,bx           ;# of chars loaded
        jb      ld20
        pop     es
        call    set_attributes
        ret

lderr:  pop     es
        mov     si,offset err_msg_10  ;"Data error in old race file...
        mov     di,21*160 + 11*2
        mov     ah,70h
        call    display
        mov     ah,1
        int     21h
        ret
load_race_file  endp


;----- MARK DNFs -----
mark_dnf  proc  near            ;Ck legal columns to mark for DNF
        mov     ax,0
        mov     al,cols_fin
        cmp     ax,col
        je      dnf1
        call    boop            ;Illegal col.
        ret

dnf1:   mov     al,screen_st
        add     al,row
        sub     al,3
        mov     dx,160
        mul     dx              ;ROWI = (SCREEN_ST + ROW - 3) * 160
        mov     di,col
        shl     di,1            ;* 2 for word
        add     di,ax
        mov     ah,0ch          ;light red
        mov     cx,6
        mov     si,offset dnf_string
dnf3:   lodsb
        mov     [screen_area + di],ax
        inc     di
        inc     di
        loop    dnf3
        mov     display_flag,1
        call    calc_totals
        ret
mark_dnf  endp


;----- MARK DNRs -----
mark_dnr  proc  near            ;Ck legal columns to mark for DNR
        mov     ax,0
        mov     al,cols_fin
        cmp     ax,col
        je      dnr1
        call    boop            ;Illegal col.
        ret

dnr1:   mov     al,screen_st
```

```
        add     ax,row
        sub     ax,3
        mov     dx,160
        mul     dx                  ;ROWI = (SCREEN_ST + ROW - 3) * 160
        mov     di,col
        shl     di,1                ;* 2 for word
        add     di,ax
        mov     ah,0ch              ;light red
        mov     cx,8
        mov     si,offset dnr_string
dnr3:   lodsb
        mov     [screen_area + di],ax
        inc     di
        inc     di
        loop    dnr3
        mov     display_flag,1
        call    calc_totals
        ret
mark_dnr  endp


;----- MARK FINISH TIME -----
mark_finish_time  proc  near    ;AL has A, C, or M
;  Determine location for finish time -- first available slot
        mov     dx,ax           ;save type
        mov     ax,col_fin
        shl     ax,1
        mov     di,offset screen_area
        add     di,ax
mft10:  mov     al,[di]
        cmp     al,' '
        je      mft20
        add     di,160
        cmp     di,offset screen_area + 160*250
        jb      mft10

;  No place to put finish time
        mov     di,65*2+160*2
        mov     si,offset err_msg_6     ;"Finish overflow"
        mov     ah,8fh
        call    display
        call    boop
        ret

;  Copy time
mft20:  push    es
        mov     ax,data
        mov     es,ax
        cmp     dl,'A'
        je      mft30
        cmp     dl,'C'
        jne     mft40
mft30:  mov     si,offset auto_finish_time
        jmp     mft60
mft40:  cmp     dl,'M'
        je      mft50
        mov     dl,'E'  ;error
mft50:  mov     si,offset manual_finish_time

mft60:  mov     ah,87h          ;Normal flash
        mov     cx,8
mft90:  lodsb
        stosw
        loop    mft90
        mov     al,dl
        stosw                   ;display type
```

```
        pop     es
        mov     display_flag,1
        ret
mark_finish_time        endp

;----- MARK START TIME -----
mark_start_time  proc  near     ;AL has A, C, or M
;  Determine location for start time -- first available slot from end
        mov     dx,ax           ;save type
        mov     ax,col_start
        shl     ax,1
        mov     si,ax
        mov     di,offset screen_area
        add     di,ax
        add     di,160*250
        mov     al,[di]
        cmp     al,' '
        je      mst10
        jmp     mst15

mst10:  mov     al,[di]
        cmp     al,' '
        jne     mst20
        sub     di,160
        cmp     di,offset screen_area
        ja      mst10
        mov     di,si
        add     di,offset screen_area
        jmp     mst22           ;first start entry

;  No place to put start time
mst15:  mov     di,65*2+160*2
        mov     si,offset err_mss_7     ;"Start overflow"
        mov     ah,8fh
        call    display
        call    bcop
        ret

;  Copy time
mst20:  add     di,160
mst22:  push    es
        mov     ax,data
        mov     es,ax
        cmp     dl,'A'
        je      mst30
        cmp     dl,'C'
        jne     mst40
mst30:  mov     si,offset auto_start_time
        jmp     mst80
mst40:  cmp     dl,'M'
        je      mst50
        mov     dl,'E'  ;error
mst50:  mov     si,offset manual_start_time

mst80:  mov     ah,8ah          ;Green flash
        mov     cx,8
mst90:  lodsb
        stosw
        loop    mst90
        mov     al,dl
        stosw                   ;display type
        pop     es
        mov     display_flag,1
        ret
mark_start_time endp
```

```
;----- PRINT FINISH TIME -----
print_finish_time  proc near
        mov     cx,18
        cmp     manual,0
        je      pf5
        mov     si,offset pt_finish_string1     ;FINISH ... manual
        jmp     pf10
pf5:    mov     si,offset pt_finish_string2     ;FINISH ... auto
pf10:   lodsb
        call    pt_bufr_ld
        loop    pf10

        mov     si,offset time  ;Time has finish time just received
        mov     cx,11
pf20:   lodsb
        call    pt_bufr_ld
        loop    pf20

        mov     al,0dh          ;CR
        call    pt_bufr_ld
        ret
print_finish_time  endp



;----- PRINT CHARACTER FROM BUFFER -----
print_it proc near      ;print info. in pntr buffer - 1 char per pass
;  check printer status
        cmp     pt_err_flag,0
        je      pi10
        mov     pt_err_flag,0
        mov     dx,pt_adpt              ;start addr of pntr adapter
        inc     dx
        in      al,dx                   ;adpt s/b 11011xxx
        test    al,8                    ;bit 3 = 0 if printer error
        jz      pierr
        jmp     pi10                    ;printer OK

;  printer fault
pierr:  mov     si,offset err_msg_4     ;"printer fault"
        mov     di,160+65*2
        mov     ah,9                    ;intense underlined
        call    display
        mov     pt_err_flag,1
        ret

;  get char. from pntr buffer
pi10:   mov     bx,pt_unload
        cmp     bx,pt_load
        jne     pi11
        ret                             ;nothing to print

;  ck for pntr error
pi11:   mov     dx,pt_adpt
        inc     dx
pi12:   in      al,dx                   ;get pntr status
        test    al,8                    ;bit 3 = 0 if error
        jz      pierr
        test    al,80h                  ;bit 7 = 1 if printer normal
        jnz     pi13
        ret                             ;printer busy

pi13:   mov     al,[pt_buffer+bx]       ;get char.
        and     al,7fh                  ;mask off high bit
        mov     dx,pt_adpt
```

```
        out     cx,al           ;output char
        add     dx,2            ;output cntl reg
        mov     al,0fh          ;strobe bit = 1 | auto-lf
        out     dx,al
        mov     al,0eh          ;strobe bit = 0 | auto-lf
        out     dx,al
pi14:   inc     bx              ;unload ptr
        cmp     bx,pt_bufr_size
        jb      pi15
        mov     bx,0
pi15:   mov     pt_unload,bx    ;update unload ptr
        ret                     ;1 char per pass
print_it endp


;----- PRINT START TIME -----
print_start_time  proc near     ;Print time as soon as start is logged
        mov     cx,16
        cmp     manual,0
        je      ps5
        mov     si,offset pt_start_string1  ;Start _ Manual_
        jmp     ps10
ps5:    mov     si,offset pt_start_string2  ;Start... Auto
ps10:   lodsb
        call    pt_bufr_ld
        loop    ps10

        mov     cx,11
        mov     si,offset time
ps30:   lodsb
        call    pt_bufr_ld
        loop    ps30

        mov     al,0dh          ;CR
        call    pt_bufr_ld
        ret
print_start_time  endp


;----- PROCESS KEYIN -----    BCF
process_keyin   proc    near    ;Edit for legal char and col
;  Test for legal characters
        cmp     al,' '
        jne     pk3
        cmp     col,21          ;col legal for spaces are 0-20, 49-
        jb      pk2
        cmp     col,48
        ja      pk2
        call    bccp
        ret
pk2:    jmp     pk30

pk3:    cmp     edit_flag,1
        jne     pk10
        cmp     al,'.'          ;legal in FS edit only
        jne     pk5
        cmp     col,26
        je      pk4
        cmp     col,36
        jne     pk9
pk4:    jmp     pk30

pk5:    cmp     al,':'          ;legal in FS edit only
        jne     pk10
        cmp     col,23
        je      pk6
```

```
        cmp     col,33
        jne     pk9
pk8:    jmp     pk30

pk9:    call    beep            ;'.' or ':' in illegal col or not FS edit
        ret

pk10:   cmp     al,'0'
        jl      pk17            ;!!! - char below zero
        cmp     al,'9'
        jle     pk20

pk11:   and     al,0dfh         ;upper case it
        cmp     al,'A'
        jb      pk17
pk12:   cmp     al,'Z'
        jg      pk17
pk13:   cmp     col,5           ;legal cols alpha are 0-2, 4, 10-19
        jb      pk30            ;class# or race#
        cmp     col,10          ;bib#
        jb      pk17
        cmp     col,19          ;name
        jb      pk30
        cmp     col,20
        jb      pk30

        cmp     edit_flag,1
        jne     pk17
        cmp     col,29          ;A M or C in start in FS edit
        je      pk15
        cmp     col,39          ;A M or C in finish in FS edit
        je      pk15
pk15:   cmp     al,'A'
        je      pk30
        cmp     al,'C'
        je      pk30
        cmp     al,'M'
        je      pk30

pk17:   call    beep            ;Illegal char or ill char in col
        ret

pk20:   cmp     edit_flag,1
        je      pk30
pk22:   cmp     col,21
        je      pk25
        cmp     col,31
        jne     pk30
pk25:   call    beep            ;Illegal column
        ret

pk30:   cmp     col,2           ;CL#
        ja      pk31
        mov     ah,7            ;normal
        jmp     pk70
pk31:   cmp     col,4           ;race number
        jne     pk32
        mov     ah,70h
        cmp     al,' '          ;space?
        jne     pk31a
        mov     ah,7            ;normal if space
pk31a:  cmp     color_flag,1
        jne     pk31c
        mov     ah,attr_race_num
pk31c:  jmp     pk70
```

```
pk32:   cmp     col,9           ;bib #
        ja      pk33
        mov     ah,0eh          ;Yellow chars
        jmp     pk70

pk33:   cmp     col,19          ;Last name
        ja      pk34
        mov     ah,70h
        cmp     color_flag,1
        jne     pk33a
        mov     ah,attr_last_name
pk33a:  jmp     pk70

pk34:   cmp     col,47          ;Pen pts and BIB #s for finishes
        jb      pk35
        mov     ah,0eh          ;yellow
        jmp     pk70

pk35:   cmp     edit_flag,1
        je      pk36
        call    beep            ;tried to enter num in st or fin w/o FS edit
        ret

pk36:   cmp     col,30          ;FS edit - start time.  Num, : or . to get her
        ja      pk40            ;col for : and . already tested
        cmp     al,'A'
        jb      pk37
        cmp     col,29          ;A M or C in start in FS edit
        je      pk37
        call    beep
        ret
pk37:   mov     ah,0ah          ;light red
        jmp     pk70

pk40:   cmp     al,'A'
        jb      pk45
        cmp     col,39          ;A M or C in finish in FS edit
        je      pk45
        call    beep
        ret
pk45:   mov     ah,0ch          ;light green
        jmp     pk70

pk70:
        push    ax
        mov     ah,0
        mov     al,screen_st
        add     al,row
        sub     al,3
        mov     dx,160
        mul     dx              ;ROWI = (SCREEN_ST + ROW - 3) * 160
        mov     di,col
        shl     di,1            ;* 2 for word
        add     di,ax
        pop     ax              ;regain char

        mov     [screen_area + di],ax
        cmp     col,51          ;last col of penalty numbers
        jne     pk75
        call    send_data
pk75:   mov     ah,77           ;Right arrow
        call    cursor_update
        mov     display_flag,1
        ret
process_keyin endp
```

```
;----- LOAD PRINTER BUFFER -----
pt_bufr_ld proc near            ;load printer buffer ( al has char.
        push    bx
pb0:    mov     bx,pt_load              ;  al & bx changes
        mov     [pt_buffer + bx],al
        inc     bx
        cmp     bx,pt_bufr_size         ;end of buffer
        jb      pb1
        mov     bx,0
pb1:    cmp     bx,pt_unload            ;pntr buffer full?
        jz      pberr
        mov     pt_load,bx
        cmp     al,0dh          ;cr?
        jne     pb2
        mov     al,0ah          ;auto-lf
        jmp     pb0
pb2:    pop     bx
        ret

pberr:  push    di
        push    si
        mov     si,offset err_msg_3     ; "buffer overflow"
        mov     di,110
        mov     ah,87h
        call    display
pb22:   pop     si
        pop     di
        mov     pt_err_flag,1
        pop     bx
        ret
pt_bufr_ld endp


;----- PROCESS TAB -----
process_tab  proc near          ;tabs @ cols 4, 6, 10, 21, 31, 48, 61
;                               ;it's crude, but it works!
        cmp     edit_flag,0
        je      ptb5
        ret                     ;not in FS'edit
ptb5:   cmp     col,3
        ja      ptb10
        mov     col,4
        mov     col_ptr,3
        jmp     ptb100
ptb10:  cmp     col,4
        ja      ptb20
        mov     col,6
        mov     col_ptr,4
        jmp     ptb100
ptb20:  cmp     col,8
        ja      ptb30
        mov     col,10
        mov     col_ptr,7
        jmp     ptb100
ptb30:  cmp     col,19
        ja      ptb40
        mov     col,21
        mov     col_ptr,17
        jmp     ptb100
ptb40:  cmp     col,29
        ja      ptb50
        mov     col,31
        mov     col_ptr,18
        jmp     ptb100
ptb50:  cmp     col,39
```

```
        ja      ptb6_
        mov     col,49
        mov     col_ptr,19
        jmp     ptb100
ptb60:  cmp     col,51
        ja      ptb70
        mov     col,61
        mov     col_ptr,22
        jmp     ptb100
ptb70:  cmp     col,63
        ja      ptb80
        mov     col,65
        mov     col_ptr,25
ptb80:
ptb100: call    cursor
        ret
process_tab  endp


;----- REGISTER TIMES -----
register_time  proc  near       ;moves current time to [DI]
        push    es              ;DI has destination
        push    si
        push    cx
        mov     ax,data
        mov     es,ax
        mov     si,offset time+3
        mov     cx,4
        rep     movsw
        pop     cx
        pop     si
        pop     es
        ret
register_time  endp


;----- GET START & FINISH TIMES -----  BBJ
sample_switches proc near
        cmp     sample_flag,1   ;0 - no sampling
        je      s5
        ret
s5:     mov     dx,port
        in      al,dx
        and     al,0f0h         ;use bits 4-7 only
        cmp     al,0f0h         ;any low is switch closed
        jnz     s10
        ret

s10:    in      al,dx           ;resample

        test    al,20h          ;Bit 5 low? - Auto Finish
        jnz     s20
        call    auto_finish

s20:    test    al,80h          ;Bit 7 low? - Manual Finish
        jnz     s30
        call    manual_finish

s30:    test    al,10h          ;Bit 4 low? - Auto Start
        jnz     s40
        call    auto_start

s40:    test    al,40h          ;Bit 6 low? - Manual Start
        jnz     s50
        call    manual_start
```

```
s50:    ret
sample_switches  endp

auto_finish  proc  near
        cmp     auto_finish_timer,0
        je      af10
        ret                             ;already got signal
af10:   push    ax
        call    get_date_time           ;Got auto finish
        mov     bx,1000
        call    tone_on
        mov     timer_tone,4            ;.22 secs
        mov     auto_fin_timer0,185   ;2.035 sec window (dec by 5 every 55 ms
        mov     di,offset auto_finish_time
        call    register_time
        mov     manual,0
        call    print_finish_time
        mov     auto_finish_timer,4     ;set for .22 seconds (dec every 55 ms
;==     mov     byte ptr ES:[152],'!'   ;reminder
        pop     ax
        ret
auto_finish  endp

manual_finish  proc  near
        cmp     manual_finish_timer,0
        je      mf10
        ret                             ;already got signal
mf10:   push    ax
        call    get_date_time           ;Got auto finish
        mov     bx,1000
        call    tone_on
        mov     timer_tone,4            ;.22 secs
        mov     manual_fin_timer0,185 ;2.035 sec window (dec by 5 every 55 ms
        mov     di,offset manual_finish_time
        call    register_time
        mov     manual,1
        call    print_finish_time
        mov     manual_finish_timer,8   ;set for .44 seconds (dec every 55 ms
;==     mov     byte ptr ES:[152],'!'   ;reminder
        pop     ax
        ret
manual_finish  endp

auto_start  proc  near
        cmp     auto_start_timer,0
        je      as10
        ret                             ;already got signal
as10:   push    ax
        call    get_date_time           ;Got auto start
        mov     bx,500
        call    tone_on
        mov     timer_tone,4            ;.22 secs
        mov     auto_st_timer0,165      ;2 sec window
        mov     di,offset auto_start_time
        call    register_time
        mov     manual,0
        call    print_start_time
        mov     auto_start_timer,181    ;set for 10 seconds (dec every 55 ms)
        pop     ax
        ret
auto_start  endp

manual_start  proc  near
        cmp     manual_start_timer,0
        je      ms10
        ret                             ;already got signal
```

```
ms10:   push    ax
        call    set_date_time           ;Got manual start
        mov     bx,500
        call    tone_on
        mov     timer_tone,4            ;.22 secs
        mov     manual_st_timer0,185    ;2 sec window
        mov     di,offset manual_start_time
        call    register_time
        mov     manual,1
        call    print_start_time
        mov     manual_start_timer,90   ;set for 5 seconds (dec every 55 ms)
        pop     ax
        ret
manual_start  endp

;----- SCREEN REFRESH -----  CF9
screen_refresh  proc    near
;  Update top 3 lines of screen
        mov     di,0
        mov     si,offset screen_top
        mov     cx,3*80
        mov     ah,70h
sr1:    lodsb
        stosw
        loop    sr1
;  Update line 4-25 with image screen data - top at scrn_st
        mov     ax,0
        mov     di,160*3
        mov     si,offset screen_area
        mov     al,screen_st
        mov     dx,160
        mul     dx
        add     si,ax
        mov     cx,80*22
        rep     movsw
        mov     display_flag,0

;  If full-screen edit, change attribute of screen only
        cmp     edit_flag,1
        jne     sr15
        mov     al,70h
        cmp     color_flag,1
        jne     sr9
        mov     al,74h          ;red on white
sr9:    mov     di,1
        mov     cx,2000
sr10:   stosb
        inc     di
        loop    sr10

;  Place GTE on screen
sr15:   mov     si,offset GTE
        mov     di,2
        mov     ah,1fh          ;White on blue
        mov     cx,5
sr20:   lodsb
        stosw
        loop    sr20
sr30:   ret
screen_refresh endp

;----- SECONDS TO TIME -----
secs_to_time proc near          ;Tsec & dsec to time1 (xx:xx.xx)
        push    di
```

```
        push    es
        mov     ax,data         ;Point ES to DS
        mov     es,ax
        mov     di,offset time1

        mov     ax,tsec
        div     div_60          ;Quot in al  Rem in ah
        mov     cx,ax
        mov     ah,0
        div     div_10
        add     al,'0'
        stosb
        mov     al,ah
        add     al,'0'
        stosb
        mov     al,':'
        stosb
        mov     al,ch
        mov     ah,0
        div     div_10
        add     al,'0'
        stosb
        mov     al,ah
        add     al,'0'
        stosb
        mov     al,'.'
        stosb
        mov     ax,dsec
        div     div_10
        add     al,'0'
        stosb
        mov     al,ah
        add     al,'0'
        stosb
        pop     es
        pop     di
        ret
secs_to_time endp


;----- SEND DATA -----  CFO
send_data  proc  near           ;when entry made in col 50 (end of pen pts),
        push    ax              ;  certain data in row in place in com bufr
        push    bx
        push    cx
        push    dx
        push    si
        mov     ax,2            ;STX
        call    com_bufr_ld
        mov     al,screen_st
        add     al,row
        sub     al,3
        mov     dx,160
        mul     dx
        add     ax,offset screen_area   ;start of screen buffer
        mov     bx,ax
        mov     si,bx
;  Send class#
        mov     cx,3
sd10:   lodsb
        call    com_bufr_ld
        inc     si
        loop    sd10
        mov     al,' '
        call    com_bufr_ld
;  Send race#
```

```
        mov     si,bx
        add     si,4*2
        lodsb
        call    com_bufr_ld
        mov     al,' '
        call    com_bufr_ld
;  Send BIB#
        mov     si,bx
        add     si,6*2
        mov     cx,3
sd20:   lodsb
        call    com_bufr_ld
        inc     si
        loop    sd20
        mov     al,' '
        call    com_bufr_ld
;  Send name
        mov     si,bx
        add     si,10*2
        mov     cx,10
sd30:   lodsb
        call    com_bufr_ld
        inc     si
        loop    sd30
        mov     al,' '
        call    com_bufr_ld
;  Send raw totals
        mov     si,bx
        add     si,41*2
        mov     cx,7
sd40:   lodsb
        call    com_bufr_ld
        inc     si
        loop    sd40
        mov     al,' '
        call    com_bufr_ld
;  Send penalty points
        mov     si,bx
        add     si,49*2
        mov     cx,3
sd50:   lodsb
        call    com_bufr_ld
        inc     si
        loop    sd50
        mov     al,' '
        call    com_bufr_ld
;  Send totals
        mov     si,bx
        add     si,53*2
        mov     cx,7
sd60:   lodsb
        call    com_bufr_ld
        inc     si
        loop    sd60
;  Send CR
        mov     al,0dh  ;CR
        call    com_bufr_ld
        mov     al,0ah  ;CR
        call    com_bufr_ld
        pop     si
        pop     dx
        pop     bx
        pop     cx
        pop     ax
        ret
send_data  endp
```

```
;----- SET DISPLAY ATTRIBUTES -----  CFO
set_attributes  proc near
        push    es
        mov     ax,data
        mov     es,ax
        mov     di,offset screen_area + 1       ;attributes
        mov     dx,di

;  Class numbers
sa10:   mov     cx,3
        mov     al,7            ;normal

        call    set_attr
        add     di,2

;  Race number
        cmp     byte ptr [di-1],' '     ;ck for entry
        jne     sa10d
        add     di,4
        jmp     sa11d
sa10d:  mov     cx,1
        mov     al,70h
        cmp     color_flag,1
        jne     sa11
        mov     al,attr_race_num
sa11:   call    set_attr
        add     di,2
sa11d:
;  BIB numbers
        mov     cx,3
        mov     al,0eh          ;yellow
        call    set_attr
        add     di,2

;  Last Names
        cmp     byte ptr [di-1],' '     ;ck for entry
        jne     sa12
        add     di,22
        jmp     sa13
sa12:   mov     cx,10
        mov     al,70h          ;inverse
        cmp     color_flag,1
        jne     sa12a
        mov     al,attr_last_name
sa12a:  call    set_attr
        add     di,2

;  Start field
sa13:   mov     cx,8
        mov     al,0ah          ;light green
        call    set_attr
        mov     al,2            ;green
        stosb
        add     di,3

;  Finish field
        mov     cx,8
        mov     al,0ch          ;light red
        call    set_attr
        mov     al,4            ;red
        stosb
        add     di,3

;  Run time field
```

```
        mov     cx,7
        mov     al,0ch          ;cyan
        call    set_attr
        add     di,2

;  Penalty point fields
        mov     cx,3
        mov     al,0eh          ;yellow
        call    set_attr
        add     di,2

;  Totals
        mov     cx,7
        push    di
        add     di,7
        mov     al,byte ptr [di]
        pop     di
        cmp     al,'.'          ;test for entry
        je      sa20
        add     di,14
        jmp     sa30
sa20:   mov     al,70h          ;inverse
        call    set_attr
sa30:   add     di,2

;  BIB #s
        mov     cx,7
        mov     al,0eh          ;magenta
        call    set_attr

        inc     di

;  Finish entries
        mov     al,byte ptr [di]
        inc     di
        cmp     al,' '
        je      sa40
        mov     cx,9
        mov     al,074h         ;red on gray
        call    set_attr

sa40:   add     dx,160
        mov     di,dx
        cmp     dx,offset screen_area + 250*160
        ja      sa100
        jmp     sa10
sa100:  pop     es
        ret
set_attributes  endp

set_attr  proc  near    ;DI has location, CX has count, AL has attr.
sar10:  stosb
        inc     di
        loop    sar10
        ret
set_attr  endp


;----- SET START TIME -----
set_start_time proc near
;  Check legal cursor column
        mov     si,col
        cmp     si,col_start
        je      ss10
        call    beep
```

```
        mov     si,offset ill_col       ;"ILL-COL"
        jmp     serr1

;  Change attribute of start time
ss10:   mov     ah,0
        mov     al,screen_st
        add     al,row
        sub     al,3
        mov     dx,160
        mul     dx                      ;ROWI = (SCREEN_ST + ROW - 3) * 160
        mov     di,col
        shl     di,1                    ;* 2 for word
        add     di,ax
        add     di,offset screen_area.

;  Test for start entry
        mov     si,di
        lodsb
        cmp     al,' '
        jne     ss15
        mov     si,offset no_time       ;"NO-TIME"
        jmp     serr1

ss15:   push    es
        mov     ax,data
        mov     es,ax
        mov     cx,9
        mov     al,0ah                  ;green chars
ss20:   inc     di
        stosb
        loop    ss20
        mov     display_flag,1

;  Log verified start time wtih BIB #
        dec     si
        push    si                      ;start time in screen area
        mov     si,offset set_string1   ;"Set/verify start time"
ss30:   lodsb
        cmp     al,'$'
        je      ss32
        call    pt_bufr_ld
        jmp     ss30
ss32:   pop     si
        push    si

        mov     cx,9                    ;print start time
ss33:   lodsw
        call    pt_bufr_ld
        loop    ss33
        mov     al,' '
        call    pt_bufr_ld
        call    pt_bufr_ld
        pop     si
        sub     si,15*2                 ;BIB# in screen area
        mov     cx,3                    ;print BIB# associated w/ start ime
ss34:   lodsw
        call    pt_bufr_ld
        loop    ss34
        mov     al,0dh
        call    pt_bufr_ld

        pop     es
        ret

serr1:  mov     ax,0
        mov     al,row
```

```
        mov     cx,160
        mul     dx
        mov     di,col_start    ;place at start col
        shl     di,1
        add     di,ax
        mov     ah,8fh          ;Flash-intense
        mov     cx,8
ss50:   lodsb
        stosw
        loop    ss50
        mov     timer_display,2 ;at least 2 secs
        ret
set_start_time endp


;----- TEST PORTS -----
test_ports  proc  near
        mov     di,0
        mov     ax,720h
        mov     cx,2000
        rep     stosw

        mov     dx,3d9h
        mov     al,0eh
        out     dx,al
        mov     temp1,1
        mov     temp2,1

        mov     si,offset tline1
        mov     di,1120+66
        mov     ah,0eh
        call    display
pt01:   mov     si,offset tline2
        mov     di,1440+8
        mov     ah,0eh
        call    display
pt03:   mov     si,offset tline3
        mov     di,2400+52
        mov     ah,87h
        call    display

pt1:    call    sample_switches
        call    get_date_time
        mov     ax,0
        mov     dx,port
        in      al,dx
        cmp     al,bl
        jne     pt3

        mov     ah,1
        int     16h
        jz      pt1
        mov     ah,0
        int     16h
        jmp     pt40

pt3:    mov     bl,al           ;Save value in BL

;  Test automatic-start sw
        mov     di,1600 + 6*2
        test    bl,10h
        jz      pt7
        call    show_port_open
        jmp     pt10
pt7:    call    show_port_closed
```

```
;  Test manual_start sw
pt10:   mov     di,1600 + 16*2
        test    bl,40h
        jz      pt12
        call    show_port_open
        jmp     pt15
pt12:   call    show_port_closed

;  test automatic_finish sw
pt15:   mov     di,1600 + 43*2
        test    bl,20h
        jz      pt17
        call    show_port_open
        jmp     pt20
pt17:   call    show_port_closed

;  Test manual_finish sw
pt20:   mov     di,1600 + 53*2
        test    bl,80h
        jz      pt23
        call    show_port_open
        jmp     pt25
pt23:   call    show_port_closed

pt25:   jmp     pt1

pt40:   mov     di,0
        mov     ax,720h
        mov     cx,2000
        rep     stosw
        mov     display_flag,1
        call    display_blue_border
        ret
test_ports  endp

show_port_open  proc  near
        mov  si,offset open
        mov  cx,6
        mov  ah,0eh
spc10:  lodsb
        stosw
        loop spc10
        ret
show_port_open  endp

show_port_closed  proc  near
        mov  si,offset closed
        mov  cx,6
        mov  ah,70h
spc10:  lodsb
        stosw
        loop spc10
        ret
show_port_closed  endp


;----- TEST START / FINISH COINCIDENCE SIGNALS -----        1)  A *  M
test_coinc  proc  near;   (every 55 msec)          2)  A * -M   A~\_
;  Start tests                                              3) -A *  M   M~\_
        cmp     auto_st_timer0,0        ;                   4) -A * -M
        je      t20             ;No auto - test manual
        cmp     manual_st_timer0,0
        je      t10

        mov     al,'C'          ;coincidence start      [1]
```

```
        call    mark_start_time
        mov     manual_st_timer0,0
        mov     auto_st_timer0,0
        jmp     t100

t10:    sub     auto_st_timer0,5
        cmp     auto_st_timer0,0
        jne     t100            ;auto counting - no manual

        mov     al,'A'          ;Auto  - no manual      {2}
        call    mark_start_time
        jmp     t100

t20:    cmp     manual_st_timer0,0
        je      t100            ;no auto  no manual     {4}

        sub     manual_st_timer0,5
        cmp     manual_st_timer0,0
        jne     t100            ;no auto  manual counting

        mov     al,'M'          ;no auto - manual       {3}
        call    mark_start_time
        jmp     t100


;  finish tests
t100:   cmp     auto_fin_timer0,0
        je      t120            ;No auto - test manual
        cmp     manual_fin_timer0,0
        je      t110

        mov     al,'C'          ;coincidence finish     {1}
        call    mark_finish_time
        mov     manual_fin_timer0,0
        mov     auto_fin_timer0,0
        jmp     t200

t110:   sub     auto_fin_timer0,5
        cmp     auto_fin_timer0,0
        jne     t200            ;auto counting - no manual

        mov     al,'A'          ;Auto - no manual       {2}
        call    mark_finish_time
        jmp     t200

t120:   cmp     manual_fin_timer0,0
        je      t200            ;no auto  no manual     {4}

        sub     manual_fin_timer0,5
        cmp     manual_fin_timer0,0
        jne     t200            ;no auto  manual counting

        mov     al,'M'          ;no auto - manual       {3}
        call    mark_finish_time
        jmp     t200

t200:   ret
test_coinc  endp


;----- TIME CONVERSION ----
timecon  proc near      ;Converts mins/secs etc. into packed values
        cmp     dl,10
        jl      gts2
        mov     ax,0
        mov     al,dl
```

```
        div     div_10          ;Separate tens
        mov     bx,ax           ;Quotient in AL - rem in AH
        mov     al,bl
        add     al,'0'
        mov     ah,bh
        add     ah,'0'
        ret
gts2:   mov     al,'0'
        add     dl,'0'
        mov     ah,dl
        add     ah,'0'
        mov     ah,dl
        ret
timecon  endp


;----- TIME TO SECONDS -----
time_to_secs proc near          ;Convert time pointed to by si to
        push    si              ;  tsec (3600 max) & dsec (tens secs)
        push    dx
        call    calc_a2n        ;2-digit ascii to number in ax
        mov     dx,60
        mul     dx
        mov     tsec,ax         ;tsec = min * 60
        add     si,3*2
        call    calc_a2n
        add     tsec,ax         ;tsec = min * 60 + sec
        add     si,3*2
        call    calc_a2n
        mov     dsec,ax
        pop     dx
        pop     si
        ret
time_to_secs endp


;----- TONE OFF -----
tone_off proc near
        push    ax
        cli
        in      al,61h
        and     al,0fch
        out     61h,al
        pop     ax
        sti
        ret
tone_off  endp


;----- TONE ON -----
tone_on  proc near      ;Freq of tone in bx
        push    ax
        cli                     ;Disable intr
        in      al,61h
        or      al,3
        out     61h,al
        mov     al,0b6h
        out     43h,al
        mov     al,bl
        out     42h,al          ;lsb
        mov     al,bh
        out     42h,al          ;msb
        pop     ax
        sti
        ret
tone_on  endp
```

```
;----- TRANSFER FINISH TIMES -----
xfer_finish_time proc near
;  Check legal cursor columns for xfer
        mov     adj_flag,0      ;Clear flag for .1 sec adj
        mov     si,col
        cmp     si,61           ;Cols 61, 62, 63
        je      x15
        cmp     si,62
        jne     x1
        dec     si
        jmp     x15
x1:     cmp     si,63
        jne     x3
        sub     si,2
        jmp     x15


x3:     mov     adj_flag,1      ;.1 sec adj column
        cmp     si,65           ;Cols 65, 66, 67
        je      x15
        cmp     si,66
        jne     x5
        dec     si
        jmp     x15
x5:     cmp     si,67
        jne     x10
        sub     si,2
        jmp     x15


x10:    call    beep            ;Cursor in illegal col for xfer
        mov     si,offset ill_col       ;" ILL-COL"
        jmp     xerr1

;  Get bib# of finish time
x15:    shl     si,1
        mov     ax,0
        mov     al,screen_st
        add     al,row
        sub     al,3    ;cursor_img = [screen_st + row - 3]*160 + col*2
        mov     dx,160
        mul     dx
        add     si,ax           ;Cur loc
        add     si,offset screen_area
        mov     bib_si,si
        lodsw
        cmp     al,' '
        jne     x20
        jmp     x28
x20:    mov     bib,al
        lodsw
        cmp     al,' '
        jne     x22
        jmp     x28
x22:    mov     [bib + 1],al
        lodsw
        cmp     al,' '
        jne     x24
        jmp     x28
x24:    mov     [bib + 2],al
        jmp     x30

x28:    call    beep            ;space in bib#
        mov     si,offset ill_space
        jmp     xerr1
```

```
; Search for bib match - no  at  bottom
x30     mov     match_row,030
        mov     dx,050*160-6*2
x30:    mov     s ,dx
        mov     ax,[screen_area + si]   ;Col 6 #
        cmp     al,bib                  ;Digit 1 of bib#
        jne     x40
        add     si,2
        mov     ax,[screen_area + si]
        cmp     al,[bib + 1]
        jne     x40
        add     si,2
        mov     ax,[screen_area +si]
        cmp     al,[bib + 2]
        je      x100

x40:    cmp     match_row,0
        je      x45
        dec     match_row
        sub     dx,160
        jmp     x30

; No match
x45:    call    boop
        mov     si,offset no_match
xerr1:  mov     ax,0
        mov     al,row
        mov     dx,160
        mul     dx
        mov     di,72*2
        add     di,ax
        mov     ah,8fh          ;Flash-intense
        mov     cx,8
x50:    lodsb
        stosw
        loop    x50
        mov     timer_display,2 ;at least 2 secs
        call    boop
        ret

; Match found - mov finish time in image area from col 69 to assoc. fin.
x100:   add     dx,offset screen_area
        mov     match_loc,dx    ;dx has loc in image area of match
        cmp     adj_flag,1      ;.1 sec adj?
        je      x120
        mov     si,bib_si       ;Start of bib# near finish time
        add     si,8*2          ;Finish time is 8 cols past st of bib #1
        jmp     x130

x120:   mov     si,bib_si       ;Current cursor loc
        add     si,4*2          ;Finish time is 4 cols past st of bib #1

x130:   push    si              ;Ck for ":" in time to xfer
        add     si,2*2
        lodsb
        pop     si
        cmp     al,':'
        je      x135
        mov     si,offset no_time       ;"NO-TIME
        jmp     xerr1

x135:   mov     di,match_loc
        add     di,25*2         ;25 cols past start of bib# near name

; CK for run #1 finish entry
x140:   push    si
```

```
        mov     si,meter_loc        ;Look for start time.  No start - no xfer
        add     si,17*2             ; ':' location in start time near name
        lodsb
        cmp     al,':'
        jne     x150
        mov     si,di               ;Look at destination - 2nd col in finish time
        add     si,2
        lodsb
        dec     si
        cmp     al,' '
        jne     x150
        jmp     x300                ;Move finish time

x150:   pop     si
        mov     si,offset no_xfer       ;" NO XFER "
        jmp     xerr1

x300:   mov     di,si
        sub     di,2
        pop     si                  ;si=souce fin time - di=dest fin time

;  Xfer finish time to run #
        mov     fin_si,si
        cmp     adj_flag,1          ;Need to add .1 sec ??
        je      x350
        push    es
        mov     ax,data
        mov     es,ax
        mov     ah,0ch              ;Red chars
        mov     cx,9
x310:   lodsb
        inc     si
        stosw
        loop    x310
        jmp     x400

;  Add .1 sec to finish time
x350:   call    time_to_secs        ;Convert time at si to tsec & dsec
        add     dsec,10             ;  si not changed
        cmp     dsec,100
        jl      x360
        sub     dsec,100
        inc     tsec
        cmp     tsec,3600
        jl      x360
        mov     tsec,0
x360:   call    secs_to_time        ;Tsec, dsec -> xx:xx.xx (time1)

        mov     si,offset time1
        push    es
        mov     ax,data
        mov     es,ax
        mov     ah,0ch              ;Red chars
        mov     cx,9
x370:   lodsb
        mov     bx,si
        stosw
        loop    x370

;  Log transfer time
x400:   mov     si,offset xfer_string1
x410:   lodsb
        cmp     al,'$'
        je      x420
        call    pt_bufr_ld
        jmp     x410
```

```
x420:   mov     si,fin_si       ;pointer to finish time or screen image
        mov     cx,9
x425:   lodsw
        call    pt_bufr_ld
        loop    x425
        mov     al,' '
        call    pt_bufr_ld
        call    pt_bufr_ld
        mov     al,bib
        call    pt_bufr_ld
        mov     al,[bib + 1]
        call    pt_bufr_ld
        mov     al,[bib + 2]
        call    pt_bufr_ld
        mov     al,0dh
        call    pt_bufr_ld

;  Change attribute of time being transfered
x500:   mov     di,fin_si
        mov     cx,9
        mov     al,74h          ;red on lt gray
x510:   inc     di
        stosb
        loop    x510
        mov     display_flag,1
        pop     es
        ret
xfer_finish_time endp


;----- UART INIT ----- 1604
uart_init  proc  near
        mov     dx,uart
        add     dx,3
        mov     al,80h
        out     dx,al
        mov     dx,uart
        mov     al,baud_rate_code
        out     dx,al
        inc     dx
        mov     al,0
        out     dx,al
        mov     al,7
        mov     dx,uart
        add     dx,3
        out     dx,al
        sub     dx,2
        mov     al,0
        out     dx,al
        ret
uart_init  endp


;----- WRITE DATA TO DISK -----
write_race_file proc near
        mov     dx,offset outfile
        mov     cx,0            ;if create, attribute is 0
        mov     al,2            ;if open, read & write attribute
        mov     ah,3ch          ;open or create if no file exists
        clc
        int     21h
        jnc     w5              ;no carry if opened or created OK

;  disk error - cannot create file
        mov     si,offset err_msg_3
        mov     di,160*2
```

```
        mov     ah,07h
        call    display
        ret

w5:     mov     file_handle,ax

;Determine last line to write - find 1st non-space char from end of data
        mov     si,offset screen_area_end - 2
        std
w10:    lodsw
        cmp     al,' '
        je      w10             ;Keep looking until non-space is found
        cmp     si,offset screen_area
        ja      w20
        cld
        jmp     wclose          ;Nothing on screen to write

w20:    mov     end1,si
        cld
        sub     si,offset screen_area
        mov     cx,si           ;# of significant bytes

;  determine # of 80-byte records exits
        mov     bx,cx
        shr     bx,1            ; div by 2
        mov     ax,bx
        div     div_80
        cmp     ah,0            ;remainder
        je      w30             ;quotient in AL
        mov     ah,0
        inc     al              ;next whole number
w30:    mov     records,ax

;  mov chars to disk trans area - 78 chars plus CR LF for 80 char records
        push    es              ;screen column 79 & 80 rejected
        mov     ax,data
        mov     es,ax
        mov     si,offset screen_area
        mov     di,offset dta
        mov     dx,0
        mov     cx,78
w40:    lodsw                   ;char plus attrib
        stosb
        loop    w40
        mov     al,CR
        stosb
        mov     al,LF
        stosb
        add     si,4            ;skip col 79 & 80 data
        inc     dx
        cmp     dx,records
        jge     w50
        mov     cx,78
        jmp     w40

w50:    pop     es
        mov     ax,records
        mov     dx,80
        mul     dx
        mov     cx,ax           ;# of bytes to write

;  write 80 char records which include CR & LF
        lea     dx,dta
        mov     bx,file_handle
        mov     ah,40h          ;write
        clc
```

```
        int     21h
        jnc     wclose          ;written OK

        mov     si,offset err_msg_8
        mov     di,160*2
        mov     ah,89h
        call    display

wclose: mov     bx,file_handle  ;Close file
        mov     ah,3eh
        int     21h
        ret
write_race_file endp



;-----  START UP PROCEDURES -----
start_up proc near

        call    tone_off        ;speaker off
        mov     bx,408h         ;Get printer adptr addr
        mov     ax,es:[bx]
        mov     pt_adpt,ax

        mov     bx,4f0h         ;Store program code seg
        mov     ax,seg_code
        mov     es:[bx],ax

        mov     bx,410h         ;Det. type of display
        mov     ax,es:[bx]
        and     ax,30h
        cmp     al,20h
        je      su10
        mov     ax,0b000h       ;monochrome
        mov     adr_6845,3b4h
        jmp     su12
su10:   mov     ax,0b800h       ;Color
        mov     adr_6845,3d4h
        mov     color_flag,1
su12:   mov     es,ax
        mov     video_adpt,ax

        mov     row,21          ;Set DOS cursor
        mov     col,1
        call    cursor

        mov     ax,0720h        ;Clear screen
        mov     di,0
        mov     cx,2000
        rep     stosw

;Ck size of memory
        int     12h             ;Get memory size
        cmp     ax,99H
        jge     su35
        mov     si,offset err_msg_1     ;"Insuff memory ...
        mov     di,24*160+30
        mov     ah,70h
        jmp     suerr

suerr:  call    display
        mov     error_flag,1
        ret

su35:
```

```
; Opening screen
su40:   mov     si,offset gte_1         ;"Timing & Soft..
        mov     di,24*160+70            ;Last line  col 40
        mov     ah,0fh                  ;White
        call    display

su45:   mov     si,offset open_screen_1
        mov     dx,5*160+48
        mov     cx,6                    ;# of major lines to disp
        mov     ah,0eh                  ;Yellow
su48:   mov     di,dx
        call    display
su55:   add     dx,320                  ;Skip 1 line (LF + 1)
        dec     cx
        jne     su48
        call    get_date_time
        mov     si,offset date
        mov     ah,0eh                  ;Yellow
        call    display

        mov     ah,2ah  ;get date
        int     21h
        cmp     cx,1988
        jge     su60
        mov     si,offset err_msg_11    ;Illegal date
        mov     di,21*160+30*2
        mov     ah,04h
        call    display
        mov     error_flag,1
        ret

su60:   mov     dx,uart                 ;ck for COM existance
        add     dx,4
        mov     al,0bh
        out     dx,al
        nop
        nop
        nop
        nop
        in      al,dx
        cmp     al,0bh
        je      su100
        mov     row,18
        mov     col,11
        call    cursor
        mov     dx,offset err_msg_12    ;COM1 hardware not installed...
        mov     ah,9
        int     21h
        mov     ah,1
        int     21h

; Determine if old or new race
su100:  mov     row,20
        mov     col,31
        call    cursor
        mov     dx,offset cmd1  ;"Start new race? (y/n)
        mov     ah,9            ;display
        int     21h
        mov     ah,1            ;Keybd input
        int     21h
        or      al,20h          ;lower case it
        cmp     al,'y'
        je      su110
        cmp     al,'n'
        jne     su100           ;input error
        call    load_race_file
```

```
        jmp     suout
su110:  mov     row,21
        mov     col,29
        call    cursor
        mov     dx,offset cmd2  ;"Are you sure?
        mov     ah,9            ;display
        int     21h
        mov     ah,1            ;Keybd input
        int     21h
        or      al,20h          ;lower case it
        cmp     al,'y'
        je      su120
        cmp     al,'n'
        jne     su110
        jmp     su100

;  backup old race file if any
su120:  mov     dx,offset outfilebak
        mov     ah,41h                  ;delete old backup file
        int     21h
        mov     dx,offset outfile       ;rename DS:DX to ES:DI
        mov     di,offset outfilebak
        push    es
        mov     ax,data
        mov     es,ax
        mov     ah,56h                  ;DOS rename
        int     21h
        pop     es
        jmp     suout

suout:  mov     display_flag,1
        mov     col,0
        mov     row,3
        ret
start_up endp


 ;----- END UP PROCEDURES -----
end_up  proc  near
        mov     row,10  ;row
        mov     col,30  ;col
        call    cursor
        mov     dx,offset end_msg_1     ;Saving results to disk ...
        mov     ah,9
        int     21h
e20:    call    write_race_file

e80:    mov     row,13
        mov     col,45
        call    cursor
        mov     ah,8fh
        mov     si,offset end_msg_3     ;"END NOW?
        mov     di,13*160 + 36*2
        call    display
        mov     ah,1                    ;keyin
        int     21h
        or      al,20h                  ;lower case it
        cmp     al,'y'
        je      e130
        mov     display_flag,1          ;Contiue with program
        ret


e130:   push    es                      ;Restore cursor size
        mov     ax,0
        mov     es,ax
```

```
;===    mov     cx,460h
;===    mov     ax,our_code
;===    mov     es:[bx],ax
        pop     es
        mov     row,24
        mov     col,30
        call    cursor
        ret
end_up  endp

START ENDP
CODE  ENDS
        END     START
```

What is claimed is:

1. A computer system for timing a contestant on a water race course with separated start and finish positions, comprising:

a computer;

a first automatic switch at said start position;

a first manual switch on the start position;

a second automatic switch on the finish position;

a second manual switch at said finish position;

a card interfacing said switches and said computer for providing said computer information pertaining to the time and identification of the corresponding switch when a first automatic switch, a first manual switch, a second automatic switch, and a second manual switch is activated;

software means for programming said computer for:

(a) displaying said time and identification of the corresponding switch;

(b) stringing contestant identification with a corresponding time;

(c) comparing the times associated with said first switches and selecting as the contestant's start time the time corresponding to the first automatic switch, or in the absence of thereof, the time corresponding to the first manual switch;

(d) comparing the times associated with said second switches and selecting and displaying as the finish time the time corresponding to the second automatic switch, or the absence thereof, the time corresponding to the second manual switch; and (e) subtracting the selected start time from said selector finish time to obtain the elapsed time of the contestant, and means to display said elapsed time with identification of the corresponding contestant.

2. The computer system of claim 1 which further includes means for allowing a penalty time corresponding to a contestant to be manually entered into said computer and wherein said software means automatically adds said penalty time to the elapsed time of the contestant resulting in the overall time of said contestant.

3. The computer system of claim 1 wherein:

(a) if times associated with said first automatic switch and first manual switch are within a predetermined time window of each other, the corresponding start time is identified as coincident;

(b) if the time of said first automatic switch is outside said time window, the corresponding start time is identified as automatic; and (c) if the time of said first automatic switch is absent, the corresponding start time is identified as manual.

4. The computer system of claim 1 wherein:

(a) if times associated with said second automatic switch and second manual switch are within a predetermined time window of each other, the corresponding finish time is identified as coincident;

(b) if the time of said second automatic switch is outside said time window, the corresponding finish time is identified as automatic; and (c) if the time of the said first automatic switch is absent, the corresponding finish time is identified as manual.

* * * * *